US005093222A

United States Patent [19]

Katoh

[11] Patent Number: 5,093,222

[45] **Date of Patent: * Mar. 3, 1992**

[54] SILVER HALIDE PHOTOGRAPHIC MATERIALS

[75] Inventor: Kazunobu Katoh, Kanagawa, Japan

[73] Assignee: Fuji Photo Film Co., Ltd., Kanagawa, Japan

[ * ] Notice: The portion of the term of this patent subsequent to Sep. 11, 2007 has been disclaimed.

[21] Appl. No.: 262,634

[22] Filed: Oct. 26, 1988

[30] Foreign Application Priority Data

Oct. 26, 1987 [JP] Japan ..... 62-269928

[51] Int. Cl.[5] ..... G03C 1/16

[52] U.S. Cl. ..... 430/264; 430/512; 430/572; 430/573; 430/574; 430/576

[58] Field of Search ..... 430/264, 572, 573, 574, 430/576, 512

[56] References Cited

U.S. PATENT DOCUMENTS

| | | | |
|---|---|---|---|
| 3,976,492 | 8/1976 | Hinata et al. | 96/100 |
| 4,725,532 | 2/1988 | Kameoka et al. | 430/566 |
| 4,755,448 | 7/1988 | Katoh | 430/266 |
| 4,800,150 | 1/1989 | Katoh | 430/264 |
| 4,851,321 | 7/1989 | Takagi et al. | 430/264 |
| 4,873,173 | 10/1989 | Sasaoka et al. | 430/964 |
| 4,956,257 | 9/1990 | Inoue | 430/264 |

FOREIGN PATENT DOCUMENTS

| | | | |
|---|---|---|---|
| 2613377 | 10/1976 | Fed. Rep. of Germany . | |
| 61-123832 | 6/1986 | Japan | 430/574 |
| 63-108335 | 5/1988 | Japan | 430/574 |

OTHER PUBLICATIONS

Research Disclosure, vol. 176, RD No. 17643, p. 23, IV-J (Dec. 1978).
European Search Report.
Patent Abstracts of Japan, vol. 11, No. 203 (p. 591).
JP-A-62 25 745 (Fuji Photo Film Co., Ltd.).
Patent Abstracts of Japan, vol. 10, No. 183 (p. 472).
JP-A-61 29 837 (Fuji Photo Film Co., Ltd.).
U.S. Pat. No. 4,722,884 (Inoue et al.).

*Primary Examiner*—Charles L. Bowers, Jr.
*Assistant Examiner*—Janis L. Dote
*Attorney, Agent, or Firm*—Sughrue, Mion, Zinn Macpeak & Seas

[57] ABSTRACT

A negative silver halide photographic light-sensitive material comprising a support having thereon at least one silver halide emulsion layer, wherein said silver halide emulsion layer or another hydrophilic colloid layer provided on the support contains (i) a hydrazine derivative, (ii) at least one cationic dye selected from the group consisting of cyanine dyes, hemicyanine dyes and rhodacyanine dyes, and (iii) a compound represented by formula (I) and having substantially no absorption maximum at the visible region;

(I)

wherein $Z^{11}$, $Z^{12}$, $R^{11}$, $R^{12}$, X and n are defined in the specification.

14 Claims, No Drawings

SILVER HALIDE PHOTOGRAPHIC MATERIALS

FIELD OF THE INVENTION

This invention is directed toward a silver halide photographic material and a process for the formation of super-high contrast negative images utilizing the present photographic material. More particularly, the present invention is directed toward a silver halide photographic material for photomechanical process and a process for the formation of super-high contrast negative images utilizing the present photographic material.

BACKGROUND OF THE INVENTION

In the field of graphic arts, an image-forming system exhibiting photographic characteristics of super-high contrast (in particular, at least 10 in gamma) is necessary for improving the reproduction of continuous tone images by dot images or the reproduction of line images.

Prior to the present invention, lith, a specific developer has been used to achieved super-high contrast. Lith developer contains hydroquinone only as the developing agent. The concentration of a free sufite ion is greatly reduced in the lith developer (usually less than 0.1 mol/liter) because the sulfite is used as a preservative in the form of an addition product with formaldehyde so as not to obstruct the infectious developing property thereof. Therefore, the lith developer has serious faults in that the lith developer is very liable to oxidation and thus can not be stored for more than 3 days.

As processes of obtaining high-contrast photographic characteristics using a stable developer, include those processes utilizing hydrazine derivative. These processes are described in U.S. Pat. Nos. 4,224,401, 4,168,977, 4,166,742, 4,311,781, 4,272,606, 4,211,857, and 4,243,739. According to the processes, photographic characteristics having super-high contrast and high sensitivity are obtained. Further, since sulfite may be added to the developer at a high concentration, the stability of the developer to air oxidation is greatly improved.

On the other hand, various new light sources (e.g., light emitting diode (LED), He-Ne laser, and argon laser) for the light exposure of photographic light-sensitive materials have been developed and practically used. It is necessary to select proper spectral sensitizing dyes for photographic light-sensitive materials having optimum spectral sensitivity for the spectral energy distribution of such a light source. Also, such a technique has been practiced utilizing a lith developer. That is, in the aforesaid image-forming system for obtaining photographic light-sensitive materials exhibiting photographic characteristics of high contrast by utilizing a stable developer which includes a hydrazine derivative, the increase of sensitivity and contrast is accelerated. Further, the $D_{max}$, i.e., maximum density (described below) is increased by the use of a cationic compound in the photographic light-sensitive material as described in JP-A Nos. 60-140340 and 61-167939.

In regard to spectral sensitizing dyes, the use of a cationic dye as the spectral sensitizing dye gives a higher $D_{max}$ than the utilization of an anionic dye and/or a betaine dye.

However, the use of a cationic dye is accompanied by an undesirable phenomenon. More specifically, there is an increase in the formation of small black spots, so-called "black pepper" on the developed photographic light-sensitive material. This increase becomes a serious problem, especially during a photo-engraving step.

Accordingly, efforts have been made for inhibiting the formation of black peppers while maintaining high $D_{max}$ and using a cationic dye as the spectral sensitizing dye.

As a means for inhibiting the formation of black peppers, JP-A No. 62-25745 discloses a means for reducing the pH of the film surface below 5.8 using an organic acid such as ascorbic acid, acetic acid, citric acid, or salicylic acid. However, by reducing the pH alone, it is impossible to completely inhibit the formation of black peppers. Further, reducing the pH hinders the hardening of the silver halide photographic emulsion layers, whereby the emulsion layers are liable to scratching.

SUMMARY OF THE INVENTION

An object of the present invention is to provide a silver halide photographic material exhibiting the following photographic characteristics; very high contrast over 10 in gamma ($\gamma$), high $D_{max}$, a high sensitivity with the formation of less black peppers using a stable developer, and an optimum spectral sensitivity for the spectral energy distributions of various light sources.

The aforesaid object of the present invention is attained by a negative working silver halide photographic materials comprising a support having thereon at least one silver halide emulsion layer, wherein the silver halide emulsion layer or another hydrophilic colloid layer contains (i) a hydrazine derivative, (ii) at least one cationic dye selected from cyanine dyes, hemicyanine dyes and rhodacyanine dyes, and (iii) a compound represented by formula (I) having substantially no absorption maximum at the visible region;

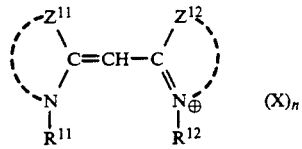

(I)

wherein $Z^{11}$ and $Z^{12}$ each represents a non-metallic group necessary for forming a benzoxazole nucleus, a benzothiazole nucleus, a benzoselenazole nucleus, a naphthoxazole nucleus, a naphthothiazole nucleus, a naphthoselenazole nucleus, a thiazole nucleous, a thiazoline nucleous, an oxazole nucleous, a selenazole nucleus, a selenazoline nucleus, a pyridine nucleus, a benzimidazole nucleus, or a quinoline nucleus; $R^{11}$ and $R^{12}$ each represents an unsubstituted or substituted alkyl group, at least one of $R^{11}$ and $R^{12}$ having an acid group; X represents a charge balancing ion; and n represents 0 or 1.

DETAILED DESCRIPTION OF THE INVENTION

The heterocyclic ring formed by $Z^{11}$ and $Z^{12}$ in formula (I) is preferably a benzoxazole nucleus, a benzothiazole nucleus, a naphthoxazole nucleus, a naphthothiazole nucleus, a thiazole nucleus, or an oxazole nucleus. More preferably, the ring formed is a benzoxazole nucleus, a benzothiazole nucleus, or a naphthoxazole nucleus, and most preferably a benzoxazole nucleus or a naphthoxazole nucleus.

In formula (I), the heterocyclic ring shown by $Z^{11}$ or $Z^{12}$ may generally have one to four substituents such as, for example, a halogen atom (e.g., fluorine, chlorine, bromine and iodine), a nitro group, an alkyl group (having, preferably, from 1 to 4 carbon atoms, e.g., methyl, ethyl, trifluoromethyl, benzyl, and phenetyl), an aryl group (e.g., phenyl), an alkoxy group (having, preferably, from 1 to 4 carbon atoms, e.g., methoxy, ethoxy, propoxy, and butoxy), a carboxy group, an alkoxycarbonyl group (having, preferably, from 2 to 5 carbon atoms, e.g., ethoxycarbonyl), a hydroxy group, and a cyano group.

In regard to $Z^{11}$ and $Z^{12}$ in formula (I), examples of the benzothiazole nucleus are benzothiazole, 5-chlorobenzothiazole, 5-nitrobenzothiazole, 5-methylbenzothiazole, 6-bromobenzothiazole, 5-iodobenzothiazole, 5-phenylbenzothiazole, 5-methoxybenzothiazole, 6-methoxybenzothiazole, 5-carboxybenzothiazole, 5-ethoxycarbonylbenzothiazole, 5-fluorobenzothiazole, 5-chloro-6-methylbenzothiazole, and 5-trifluoromethylbenzothiazole. Examples of the naphthothiazole nucleus are naphtho[2,1-d]thiazole, naphtho[1,2-d]thiazole, naphtho[2,3-d]thiazole, 5-methoxynaphtho[1,2-d]thiazole, and 5-methoxynaphtho[2,3-d]thiazole. Examples of benzoselenazole nucleus are benzoselenazole, 5-chlorobenzoselenazole, 5-methoxybenzoselenazole, 5-hydroxybenzoselenazole, and 5-chloro-6-methylbenzoselenazole. Examples of the naphthoselenazole nucleus are naphtho[1,2-d]selenazole and naphtho[2,1-d]selenazole. Examples of the thiazole nucleus are thiazole, 4-methythiazole, 4-phenylthiazole, and 4,5-dimethylthiazole. Examples of the thiazoline nucleus are thiazoline and 4-methylthiazoline.

Also, in regard to $Z^{11}$ and $Z^{12}$ in formula (I), examples of the benzoxazole nucleus are benzoxazole, 5-chlorobenzoxazole, 5-methylbenzoxazole, 5-bromobenzoxazole, 5-flurobenzoxazole, 5-phenylbenzoxazole, 5-methoxybenzoxazole, 5-ethoxybenzoxazole, 5-trifluoromethylbenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, and 5,6-dimethylbenzoxazole. Examples of the naphthoxazole nucleus are naphth[2,1-d]oxazole, naphth[1,2-d]oxazole, naphth[2,3-d]oxazole, and 5-methoxy[1,2-d]oxazole.

Furthermore, in regard to $Z^{11}$ and $Z^{12}$, examples of oxazole nucleus are oxazole, 4-methyloxazole, 4-phenyloxazole, 4-methoxyoxazole, 4,5-dimethyloxazole, 5-phenyloxazole, and 4-methoxyoxazole. Examples of the pyridine nucleus are 2-pyridine, 4-pyridine, 5-methyl-2-pyridine, and 3-methyl-4-pyridine. Examples of the quinoline nucleus are 2-quinoline, 4-quinoline, 3-methyl-2-quinoline, 5-ethyl-2-quinoline, 8-fluoro-2-quinoline, 6-methoxy-2-quinoline, 8-chloro-4-quinoline, and 8-methyl-4-quinoline. Also, examples of the benzimidazole nucleus are 5,6-dichloro-1-ethylbenzimidazole and 6-chloro-1-ethyl-5-trifluromethylbenzimidazole.

In formula (I), the alkyl group shown by $R^{11}$ or $R^{12}$ includes a substituted or unsubstituted alkyl group and at least one of $R^{11}$ and $R^{12}$ has an acid group such as a sulfo group or a carboxy group. The unsubstituted alkyl group is preferably an alkyl group having from 1 to 18 carbon atoms, and particularly from 1 to 8 carbon atoms, such as, for example, methyl, ethyl, n-propyl, n-butyl, n-hexyl, and n-octadecyl. Also, as the substituted alkyl group, it is preferred that the alkyl moiety thereof have from 1 to 6 carbon atoms, and particularly from 1 to 4 carbon atoms. The substituents per se may also contain an alkyl group preferably having 1 to 8 carbon atoms and/or on aryl group preferably having 6 to 14 carbon atoms. Examples of the substituted alkyl group are an alkyl group substituted by a sulfo group (the sulfo group may be bonded thereto through an alkoxy group or an aryl group, e.g., 2-sufoethyl, 3-sulfopropyl, 3-sulfobutyl, 4-sulfobutyl, 2-(3-sulfopropoxy)ethyl, 2-[2-(3-sulfopropoxy)ethoxy]-ethyl, 2-hydroxy-3-sulfopropyl, p-sulfophenetyl, and p-sulfophenylpropyl), an alkyl group substituted by a carboxy group (the carboxy group may be bonded thereto through an alkoxy group or an aryl group, e.g., carboxymethyl, 2-carboxyethyl, 3-carboxypropyl, and 4-carboxybutyl), a hydroxyalkyl group (e.g., 2 hydroxyethyl and 3-hydroxypropyl), an acyloxyalkyl group (e.g., 2-acetoxyethyl and 3-acetoxypropyl), an alkoxyalkyl group (e.g., 2-methoxyethyl and 3-methoxypropyl), an alkoxycarbonylalkyl group (e.g., 2-methoxycarbonylethyl, 3-methoxycarbonylpropyl and 4-ethoxycarbonylbutyl), a vinyl-substituted alkyl group (e.g., allyl), a cyanoalkyl group (e.g., 2-cyanoethyl), a carbamoylalkyl group (e.g., 2-carbamoylethyl), an aryloxyalkyl group (e.g., 2-phenoxyethyl and 3-phenoxypropyl), an aralkyl group (2-phenethyl and 3-phenylpropyl), and an aryloxyalkyl group (e.g., 2-phenoxyethyl and 3-phenoxypropyl). Of these substituted alkyl group, an aralkyl group is preferred.

The charge balancing ion shown by X in formula (I) is an optional anion capable of neutralizing the positive charge formed by the quaternary ammonium salt in the heterocyclic ring and examples thereof are bromide ions, chloride ions, iodide ions, p-toluenesulfonate ions, ethylsulfonate ions, perchlorate ions, trifluoromethanesulfonate ions, and thiocyanate ions. In this case, n in formula (I) is 1.

When one of $R^{11}$ and $R^{12}$ in formula (I) includes an anion substituent such as a sulfoalkyl substituent, the compound of formula (I) may form a betaine and in such a case the charge balancing ion shown by X is unnecessary and n is 0. When $R^{11}$ and $R^{12}$ each has one anionic substituents such as sulfoalkyl groups, X is a cationic ion, such as an alkali metal ion (i.e., sodium ion, potassium ion) and an ammonium salt ion (i.e., triethylammonium ion).

In the present invention, the compound "having substantially no absorption maximum at the visible region" means a compound giving residual color having a tone below a level of causing no practical problem on the photographic light-sensitive material. More particularly, it is a compound giving residual color having a tone below a level of causing no practical problem after development. The absorption maximum of the aforesaid compound is preferably at the wavelength region of shorter than 460 nm., and more preferably at the wavelength region of shorter than 430 nm.

Specific examples of the compound shown by formula (I) are illustrated below but the compound of this invention is not limited to them.

I-1

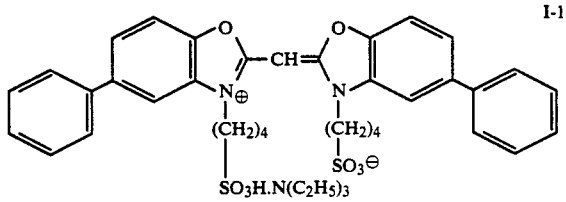

-continued
I-2
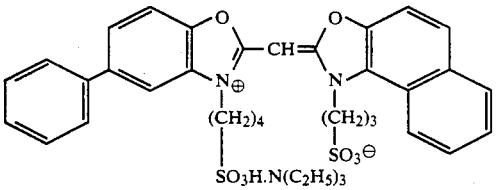
I-3
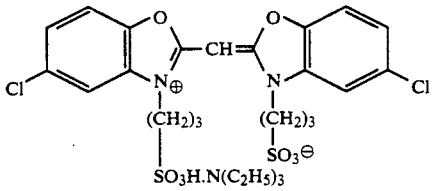
I-4
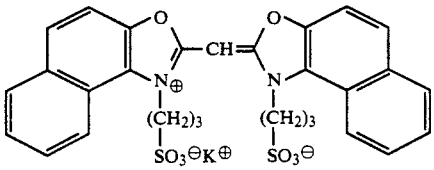
I-5
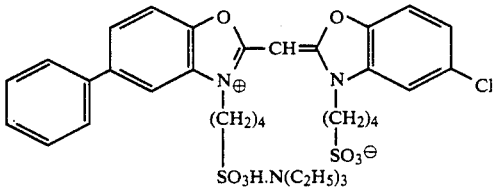
I-6
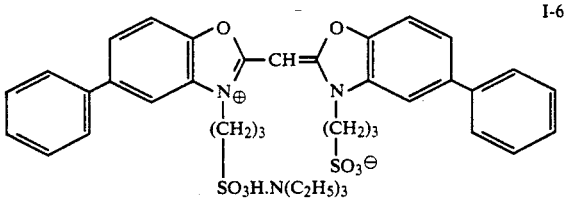
I-7
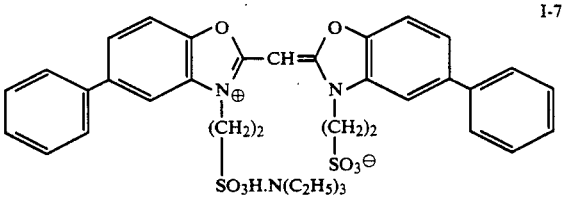
I-8
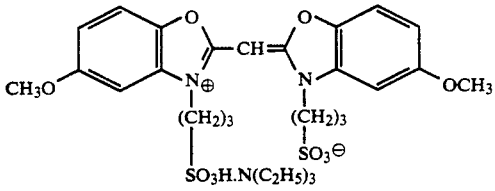
I-9
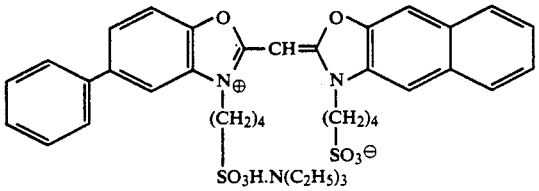
-continued
I-10
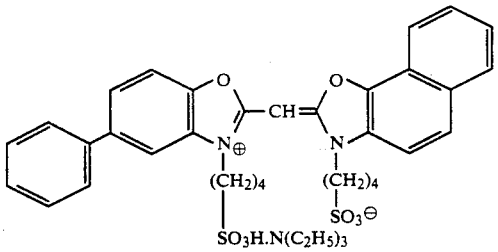
I-11
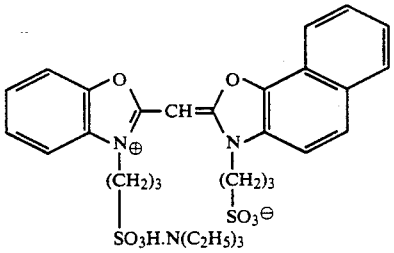
I-12
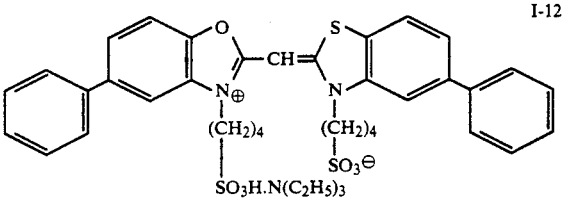
I-13
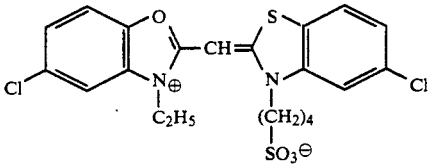
I-14
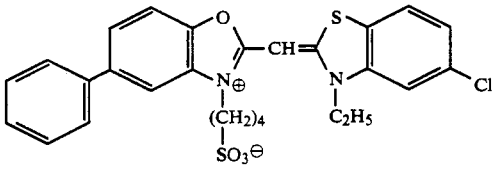
I-15
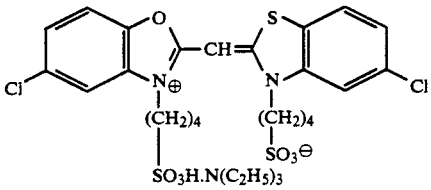
I-16
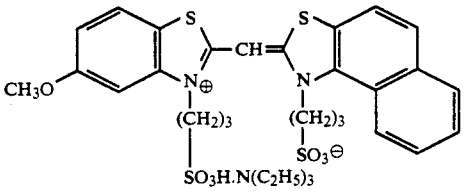

-continued

I-17

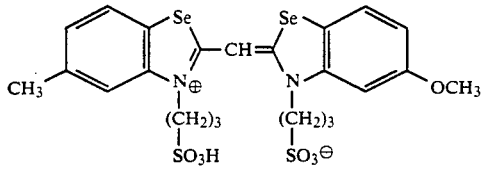

I-18

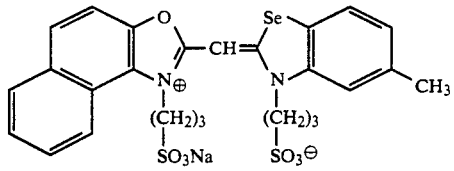

I-19

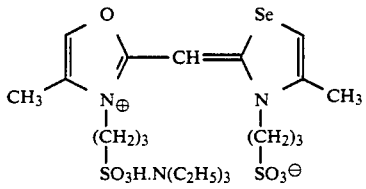

I-20

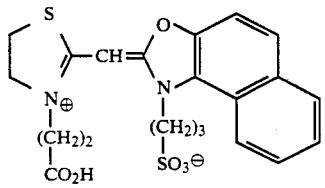

I-21

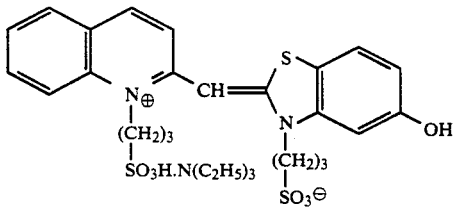

I-22

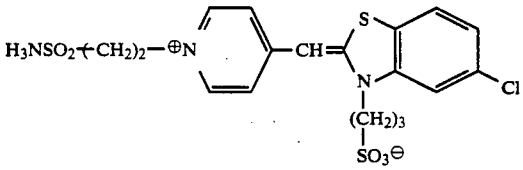

I-23

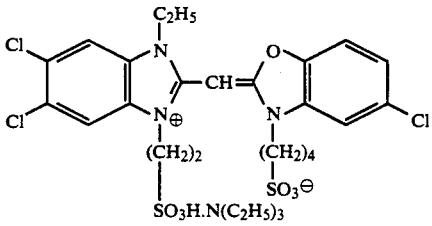

-continued

I-24

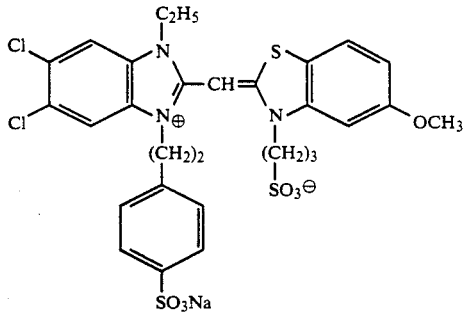

I-25

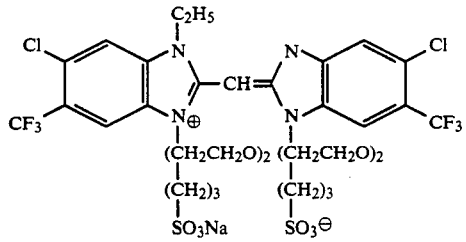

I-26

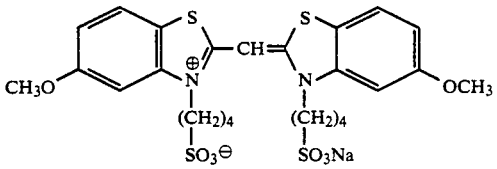

The hydrazine derivative for use in the present invention is preferably shown by formula (II)

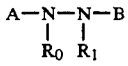

(II)

wherein A represents an aliphatic group or an aromatic group; B represents a formyl group, an acyl group, an alkylsulfonyl group, an arylsulfonyl group, an alkylsufinyl group, an arylsulfinyl group, a carbamoyl group, an alkoxycarbonyl group, an aryloxycarbonyl group, a sulfinamoyl group, an alkoxysulfonyl group, a thioacyl group, a thiocarbamoyl group, a sulfanyl group or a heterocyclic group; and $R_0$ and $R_1$ each represents a hydrogen atom, or one of $R_0$ and $R_1$ represents a hydrogen atom and the other represents a substituted or unsubstituted alkylsufonyl group, a substituted or unsubstituted arylsulfonyl group, or a substituted or unsubstituted acyl group; B, $R_1$ and the nitrogen atom to which B and $R_1$ are bonded may form a partial structure

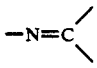

of hydrazone.

The hydrazine derivative shown by formula (II) is explained in detail below.

In formula (II), the aliphatic group shown by A has preferably from 1 to 30 carbon atoms and is more preferably a straight chain, branched or cyclic alkyl group having from 1 to 20 carbon atoms. The branched alkyl group may be cyclized so as to form a saturated heterocyclic ring containing one or more hetero atoms. Also, these alkyl groups each may have a substituent such as aryl, alkoxy, sulfoxy, sulfonamido, or carbonamido.

Specific examples thereof are t-butyl, n-octyl, t-octyl, cyclohexyl, pyrrolidyl, imidazolyl, tetrahydrofuryl, and morpholino.

In formula (II), the aromatic group shown by A is a monocyclic or dicyclic aryl group or an unsaturated heterocyclic group. The unsaturated heterocyclic group may condense with a monocyclic or dicyclic aryl group to form a heteroaryl group.

Examples of the aromatic group are benzene, naphthalene, pyridine, pyrimidine, imidazole, pyrazole, quinoline, isoquinoline, benzimidazole, thiazole, and benzothiazole, and the aromatic groups containing benzene ring are preferred.

The aryl group or the unsaturated heterocyclic group shown by A may have a substituent. Typical examples of the substituent are a straight chain, branched or cyclic alkyl group (having, preferably, from 1 to 20 carbon atoms), an aralkyl group (monocyclic or dicyclic aralkyl group the alkyl moiety of which has preferably from 1 to 3 carbon atoms), an alkoxy group (having, preferably, from 1 to 20 carbon atoms), a substituted amino group (preferably an amino group substituted by an alkyl group having from 1 to 20 carbon atoms), an acylamino group (having, preferably, from 2 to 30 carbon atoms), a sulfonamido group (having, preferably, from 1 to 30 carbon atoms), and a ureido group (having, preferably, from 1 to 30 carbon atoms).

A in formula (II) may include therein a ballast group which is usually used for photographic immobile additives such as couplers. A ballast group is a group having 8 or more carbon atoms and being relatively inactive in regard to photographic properties. Examples of the ballast group are an alkyl group, an alkoxy group, a phenyl group, an alkylphenyl group, a phenoxy group, and an alkylphenoxy group.

Also, A in formula (II) may have a group capable of increasing the adsorption to the surface of silver halide grains. Examples of such an adsorptive group are a thiourea group, a heterocyclic thiamide group, a mercaptoheterocyclic group, and a triazole group as described in U.S. Pat. Nos. 4,385,108 and 4,459,347, JP-A Nos. 59-195233, 59-200231, 59-201045, 59-201046, 59-201047, 59-201048, 59-201049, 60-179734, 61-170733, and 62-948.

In formula (II), B preferably represents a formyl group, an acyl group (e.g., acetyl, propionyl, trifluoroacetyl, chloroacetyl, benzoyl, 4-chlorobenzoyl, pyruvoyl, methoxalyl, and methyloxamoyl), an alkylsulfonyl group (e.g., methanesulfonyl and 2-chloroethanesulfonyl), an arylsulfonyl group (e.g., benzenesulfonyl), an alkylsulfinyl group (e.g., methanesulfinyl), an arylsulfinyl group (e.g., benzenesulfinyl), a carbamoyl group (e.g., methylcarbamoyl and phenylcarbamoyl), a sulfamoyl group (e.g., dimethylsulfamoyl), an alkoxycarbonyl group (e.g., methoxycarbonyl and methoxyethoxycarbonyl), an aryloxycarbonyl group (e.g., phenoxycarbonyl), a sulfinamoyl group (e.g., methyl sulfinamoyl), an alkoxysulfonyl group (e.g, methoxysulfonyl and ethoxysulfonyl), a thioacyl group (e.g., methylthiocarbonyl), a thiocarbamoyl group (e.g., methylthiocarbamoyl), or a heterocyclic group (e.g., pyridine). These groups (other than a formyl group) preferably have up to 20 carbon atoms.

More preferably, B represents a formyl group or an acyl group.

Furthermore, B in formula (II) may form a partial structure of hydrazone shown below together with $R_1$ and the nitrogen atom to which they are bonded;

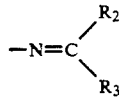

wherein $R_2$ represents an alkyl group, an aryl group, or a heterocyclic group and $R_3$ represents a hydrogen atom, an alkyl group, an aryl group, or a heterocyclic group. These groups for $R_2$ and $R_3$ preferably have up to 20 carbon atoms.

In formula (II), $R_0$ and $R_1$ each practically represents a hydrogen atom, an alkylsulfonyl group having not more than 20 carbon atoms, an arylsulfonyl group having not more than 20 carbon atoms (preferably phenylsulfonyl or phenylsulfonyl substituted such that the sum of the Hammett's substituent constants becomes more than −0.5), an acyl group having not more than 20 carbon atoms (preferably benzoyl or benzoyl substituted such that the sum of the Hammett's substituent constants becomes more than −0.5), or a straight chain, branched or cyclic unsubstituted or substituted aliphatic acyl group having not more than 20 carbon atoms. Examples of the substituent are a halogen atom, an ether group, a sulfonamido group, a carbonamido group, a hydroxy group, a carboxy group, and sulfonic acid group.

$R_0$ and $R_1$ are more preferably a hydrogen atom.

Other hydrazine derivatives which can be also used in the present invention are described in *Research Disclosure*, Item 23516, page 346 (Nov. 1983) and the literatures cited therein as well as U.S. Pat. Nos. 4,080,207, 4,269,929, 4,276,364, 4,278,748, 4,385,108, 4,459,347, 4,560,638, and 4,478,928, British Patent No. 2,011,391B, and JP-A No. 60-179734.

The hydroazine derivatives shown by formula (II) are illustrated below.

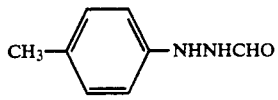

II-1)

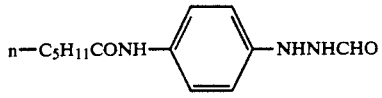

II-2)

-continued
II-3)
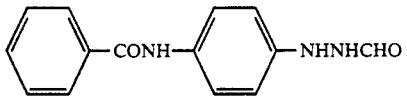
II-4)
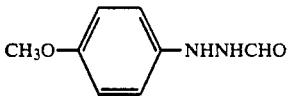
II-5)
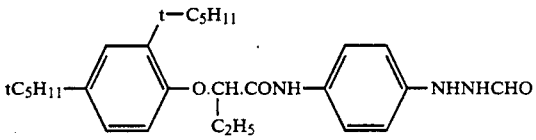
II-6)
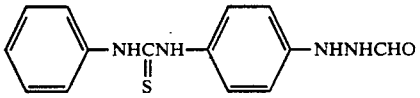
II-7)
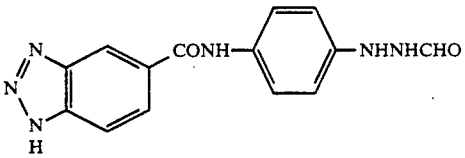
II-8)
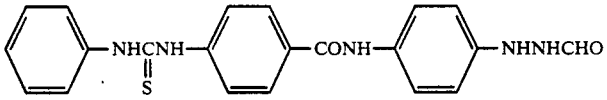
II-9)
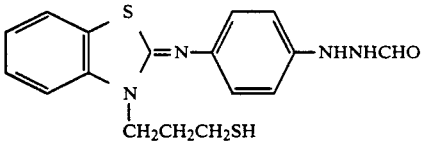
II-10)
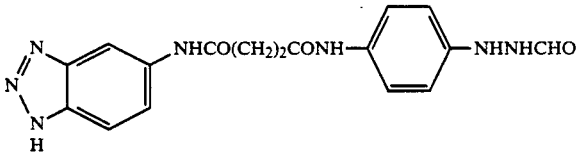
II-11)
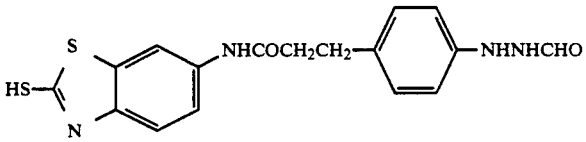
II-12)
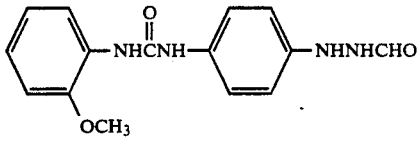
II-13)
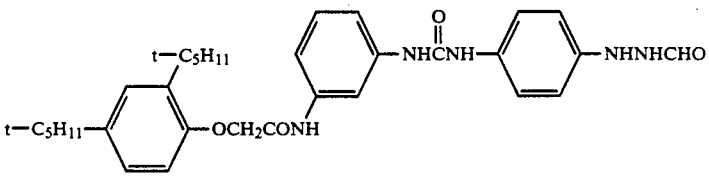

-continued
II-14)
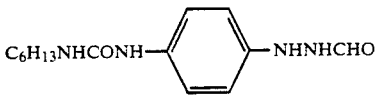
II-15)
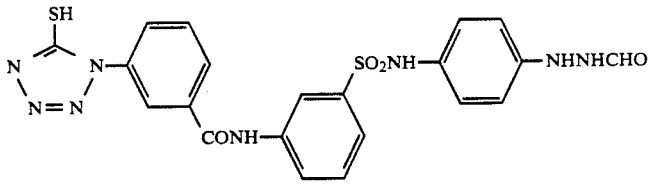
II-16)
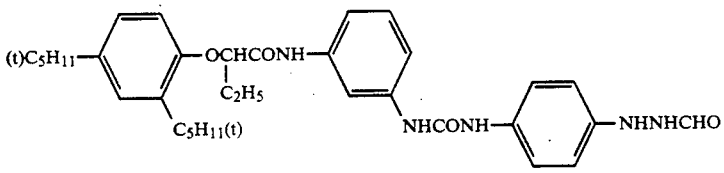
II-17)
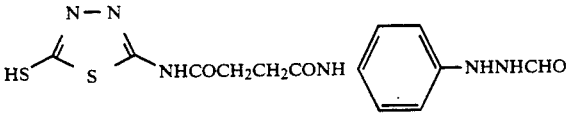
II-18)
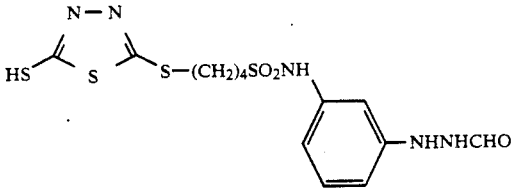
II-19)
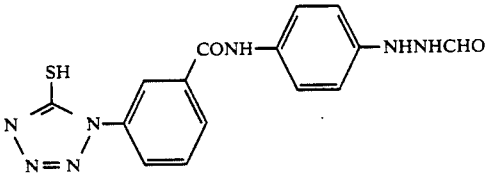
II-20)
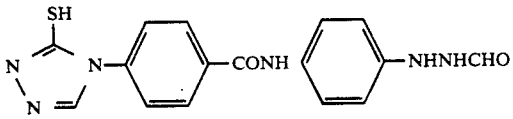
II-21)
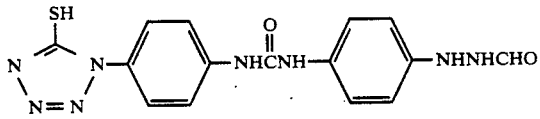
II-22)
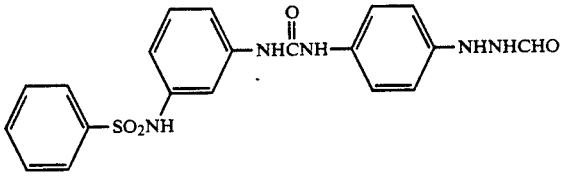
II-23)
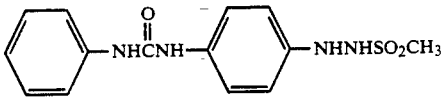

-continued
II-24)
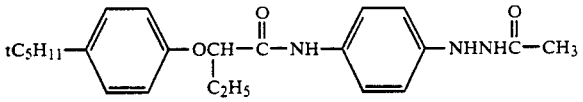
II-25)
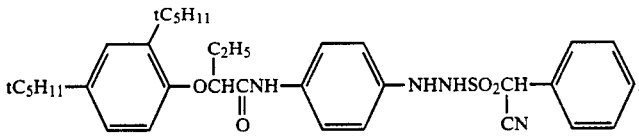
II-26)
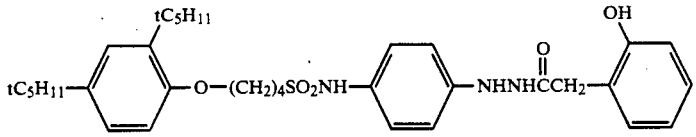
II-27)
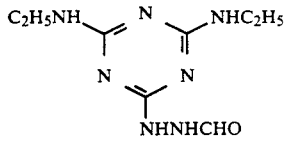
II-28)
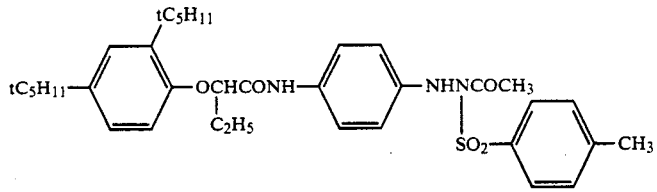
II-29)
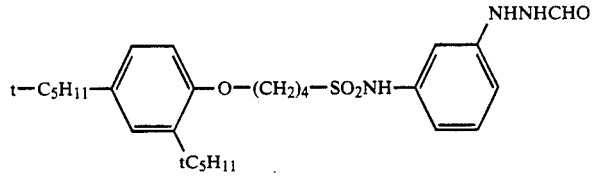
II-30)
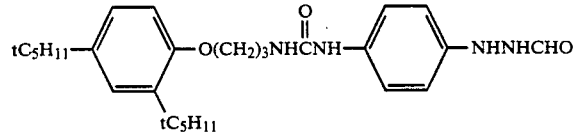
II-31)
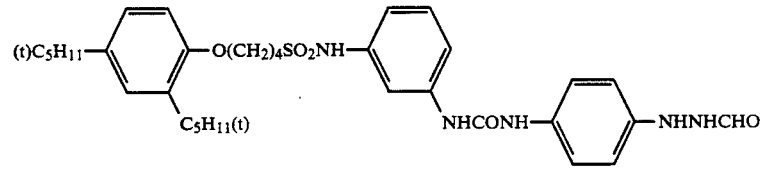
II-32)
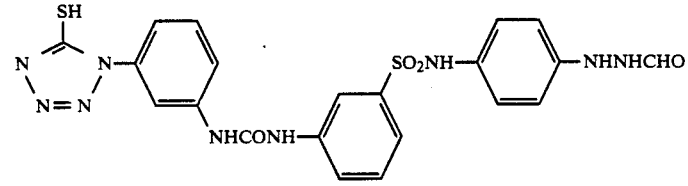

-continued

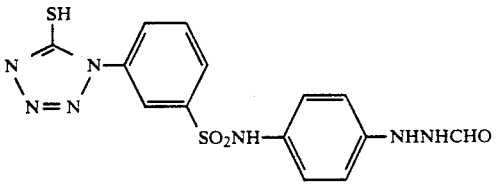

II-33)

The cationic dyes for use in this invention are described in detail below.

The cyanine dye which is used as the cationic dye in the present invention is represented by formula (III)

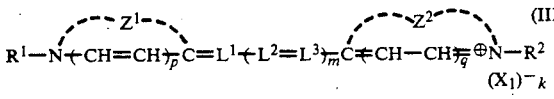

(III)

wherein $Z^1$ and $Z^2$, which may be the same or different, each represents an atomic group necessary for forming a 5- or 6-membered heterocyclic ring; $R^1$ and $R^2$, which may be the same or different, each represents an alkyl group or a substituted alkyl group; $L^1$, $L^2$, and $L^3$ each represents a methine group or a substituted methine group; p and q represent 0 or 1, and m represents 0, 1, 2, or 3, provided that p, q and m are not 0 at the same time; $X_1-$ represents an anion; and k represents 0 or 1.

The hemicyanine dye which is used as the cationic dye in the present invention is represented by formula (IV)

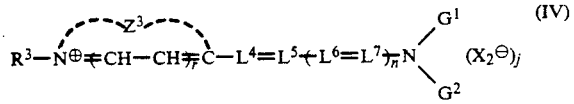

(IV)

wherein $Z^3$ has the same significance as $Z^1$ and $Z^2$; $R^3$ has the same significance as $R^1$ and $R^2$; $L^4$, $L^5$, $L^6$, and $L^7$ have the same significance as $L^1$, $L^2$, and $L^3$; r has the same significance as p and q; $X_2-$ has the same significance as $X_1-$; j has the same significance as k; n represents 0, 1 or 2; and $G^1$ and $G^2$, which may be the same or different, each represents a hydrogen atom, an alkyl group, (preferably having up to 20 carbon atoms) a substituted alkyl group thereof, an aryl group, (preferably phenyl and naphthyl), or a substituted aryl group thereof; $G^1$ and $G^2$ may together form a ring induced from a cyclic secondary amine. Examples of the substituents on the alkyl or aryl group include an alkyl group preferably having up to 8 carbon atoms, an alkyoxy group preferably having up to 8 carbon atoms, a halogen atom, a cyano group, a fluorinated alkyl group preferably having up to 8 carbon atoms, a phenyl group, a carboxy group, and a sulfoxy group.

The rhodacyanine dye which is used as the cationic dye in the present invention is represented by formula (V)

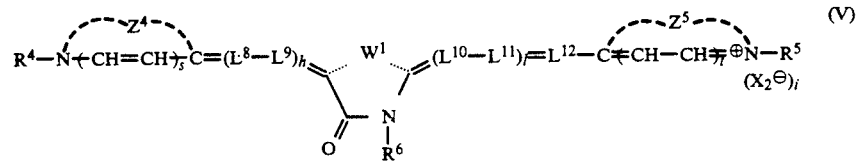

(V)

wherein $Z^4$ and $Z^5$ have the same significance as $Z^1$ and $Z^2$; $R^4$ and $R^5$ have the same significance as $R^1$ and $R^2$; $R^6$ represents a hydrogen atom, an alkyl group, a substituted alkyl group, an aryl group, a substituted aryl group, or a heterocyclic group; $L^8$, $L^9$, $L^{10}$, $L^{11}$, and $L^{12}$ have the same significance as $L^1$, $L^2$, and $L^3$; $W^1$ represents an atomic group necessary for forming a 5- or 6-membered heterocyclic ring; h and l have the same significance as m; s and t have the same significance as p and q; $X_2-$ has the same significance as $X_1-$; and i has the same significance as k.

Examples of the 5- or 6-membered heterocyclic ring formed by $Z^1$, $Z^2$, $Z^3$, $Z^4$, or $Z^5$ are a thiazole nucleus (e.g., thiazole, 4-methylthiazole, 4-phenylthiazole, 4,5-dimethylthiazole, and 4,5-diphenylthiazole), a benzothiazole nucleus (e.g., benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5 iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenetylbenzothiazole, 5-fluorobenzothiazole, 5-chloro-6-methylbenzothiazole, 5,6-methylbenzothiazole, 5-hydroxy-6-methylbenzothiazole, tetrahydrobenzothiazole, and 4-phenylbenzothiazole), a naphthothiazole nucleus (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]-thiazole, and 5-methoxynaphtho[2,3-d]thiazole), a thiazoline nucleus (e.g., thiazoline, 4-methylthiazoline, and 4-nitrothiazoline), an oxazole nucleus (e.g., oxazole, 4-methyloxazole, 4-nitrooxazole, 5-methyloxazole, 4-phenyloxazole, 4,5-diphenyloxazole, and 4-ethyloxazole), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, and 5-ethoxybenzoxazole), a naphthoxazole nucleus (e.g., naphtho[2,1-d]oxazole, naphtho[1,2-d]oxazole, naphtho[2,3-d]oxazole, and 5-nitronaphtho[2,1-d]oxazole), an isoxazole nucleus (e.g., 5-methylisoxazole and benzoisoxazole), an oxazoline nucleus (e.g., 4,4-dimethyloxazoline), a selenazole nucleus (e.g., 4-methylselenazole, 4-nitroselenazole, and 4-phenylselenazole), a benzoselenazole nucleus (e.g., benzoselenazole, 5-chlorobenzoselenazole, 5-nitrobenzoselenazole, 5-methoxybenzoselenazole, 5-hydroxybenzoselenazole, 6-nitrobenzoselenazole, and 5-chloro-6-nitrobenzoselenazole), a naphthoselenazole nucleus (e.g., naphtho[2,1-d]selenazole and naphtho[1,2-d]selenazole), a tetrazole nucleus (e.g., benzotetrazole, 5-methylbenzotetrazole, 5,6-dimethyltetrazole, 5-methoxybenzotetrazole, 5-hydroxybenzotetrazole, 5-methylthiobenzotetrazole, 5,6-dimethoxybenzotetrazole, naphtho[1,2-d]tetrazole, 8-methylnaphtho[1,2-d]tetrazole, and 6-methoxynaphtho[1,2-d]tetrazole), a 3,3-dialkyl indolenine nucleus (e.g., 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, and 3,3-dimethyl-5-chloroindolenine), an imidazole nucleus (e.g., 1-alkylimidazole, 1-alkyl-4-phenylimidazole, 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-alkylnaphth[[1,2-d]imidazole, 1-allyl-5,6-dichlorobenzimidazole, 1-allyl-5-chlorobenzimidazole, 1-arylimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole and 1-arylnaphth[1,2-d]-imidazole [wherein the alkyl moiety in the imidazole nucleus exemplified above has from 1 to 8 carbon atoms and is preferably an unsubstituted alkyl group (e.g., methyl, ethyl, propyl, isopropyl, and butyl) and a hydroxyalkyl group (e.g., 2-hydroxyethyl and 3-hydroxypropyl), and particularly preferably methyl and ethyl; and the aryl moiety is a phenyl group, a phenyl group substituted by a halogen (e.g., chlorine), a phenyl group substituted by an alkyl group (e.g., methyl), or a phenyl group substituted by an alkoxy group (e.g., methoxy)], a pyridine nucleus (e.g., 2-pyridine, 4-pyridine, 5-methyl-2-pyridine, and 3-methyl-4-pyridine), a quinoline nucleus (e.g., 2-quinoline, 3-methyl-2-quinoline, 5-ethyl-2-quinoline, 6-methyl-2-quinoline, 6-nitro-2-quinoline, 8-fluoro-2-quiniline, 6-methoxy-2-quiniline, 6-hydroxy-2-quinoline, 8-chloro-2-quinoline, 4-quinoline, 6-ethoxy-4-quinoline, 6-nitro-4-quinoline, 8-chloro-4-quinoline, 8 fluoro-4-quinoline, 8-methyl-4-quiniline, 8-methoxy-4-quinoline, isoquinoline, 6-nitro-1-isoquinoline, 3,4-dihydro-1-isoquinoline, and 6-nitro-3-isoquinoline), an imidazo[4,5-b]quinoxaline nucleus (e.g., 1,3-diethylimidazo[4,5-b]quinoxaline, and 6-chloro-1,3-diallylimiazo[4,5-b]quinoxaline), an oxadiazole nucleus, a thiadiazole nucleus, and a pyrimidine nucleus.

In formula (V) described above, examples of the 5- or 6-membered heterocyclic ring formed by $W^1$ are a rhodanine nucleus, a 2-thiohydantoin nucleus, a 2-thioxoxazolidin-4-one nucleus, a 2-pyrazolin-5-one nucleus, a barbituric acid nucleus, a 2-thiobarbituric acid nucleus, a thiazolidine-2,4-dione nucleus, a thiazolidin-4-one nucleus, an isoxazolone nucleus, a hydantoin nucleus, and an indandione nucleus.

In formulae (III), (IV) and (V) described above, $L^1$, $L^2$, $L^3$, $L^4$, $L^5$, $L^6$, $L^7$, $L^8$, $L^9$, $L^{10}$, $L^{11}$, and $L^{12}$ each represents a methine group or a substituted methine group and examples of the substituent for the substituted methine group are an alkyl group preferably having up to 20 carbon atoms (e.g., methyl and ethyl), an aryl group preferably having up to 12 carbon atoms, (e.g., phenyl), an aralkyl group preferably having up to 30 carbon atoms (e.g., benzyl), a halogen atom (e.g., chlorine and bromine), and an alkoxy group preferably having up to 20 carbon atoms (e.g., methoxy and ethoxy), and also the substituents at the methine chain may form together a 4- to 6-membered ring.

In formulae (III), (IV) and (V), the alkyl group shown by $R^1$, $R^2$, $R^3$, $R^4$, and $R^5$ is an alkyl group having from 1 to 18, preferably from 1 to 7, and particularly preferably from 1 to 4 carbon atoms such as an unsubstituted alkyl group (e.g., methyl, ethyl, propyl, isopropyl, butyl, isobutyl, hexyl, octyl, dodecyl, and octadecyl) and a substituted alkyl group, for example, an aralkyl group (e.g., benzyl and 2-phenylethyl), a hydroxyalkyl group (e.g., 2-hydroxyethyl and 3-hydroxypropyl), an alkoxyalkyl group (e.g., 2-methoxyethyl and 2-methoxyethoxyethyl), a heterocyclic-substituted alkyl group (e.g., 2-(pyridin-2-one-1-yl)ethyl and tetrahydrofurfuryl}, a 2-acetoxyethyl group, a carbomethoxymethyl group, a 2-methanesulfonylaminoethyl group, and an allyl group.

In formula (V), $R^6$ represents a hydrogen atom, an alkyl group, a substituted alkyl group, an aryl group, a substituted aryl group or a heterocyclic group. The alkyl group is an alkyl group having from 1 to 18, preferably from 1 to 7, and particularly preferably from 1 to 4 carbon atoms (e.g., methyl, ethyl, propyl, isopropyl, butyl, isobutyl, hexyl, octyl, dodecyl, and octadecyl). Examples of the substituted alkyl group are an aralkyl group (e.g., benzyl and 2-phenylethyl), a hydroxyalkyl group (e.g., 2-hydroxyethyl and 3-hydroxypropyl), an alkoxyalkyl group (e.g., 2-methoxyethyl and 2-(2-methoxyethoxy)ethyl), a heterocyclic-substituted alkyl group (e.g., 2-(pyrrolidon-2-one-1-yl)ethyl, tetrahydrofurfuryl, and 2-morpholinoethyl), a 2-acetoxyethyl group, a carbomethoxymethyl group, a 2-methanesulfonylaminoethyl group, and an allyl group.

Examples of the aryl group are phenyl and 2-naphthyl. Examples of the substituted aryl group are 4-carboxyphenyl, 4-sulfophenyl, 3-chlorophenyl and 3-methylphenyl. Also, examples of the heterocyclic group are 2-pyridyl and 2-thiazolyl.

In formulae (III), (IV) and (V), p, q, r, s, and t represent 0 or 1; m, l, and h represent 0, 1, 2, or 3; k, j, and i represent 0 or 1; and n represents 0, 1, or 2.

Specific examples of the cationic dyes for use in the present invention are illustrated below, although the dyes for use in this invention are not limited to these compounds.

1.

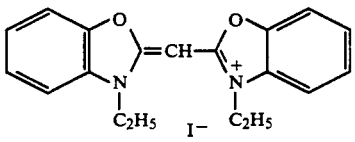

2.

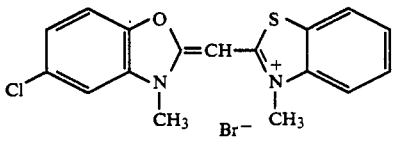

-continued
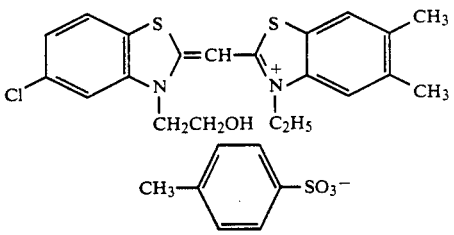
3.
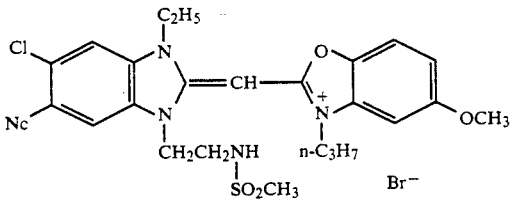
4.
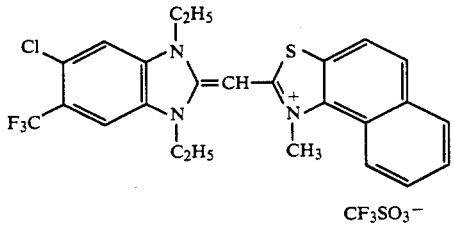
5.
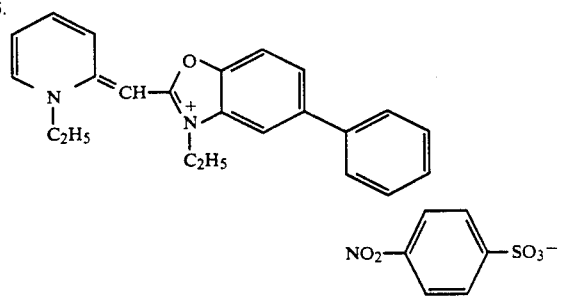
6.
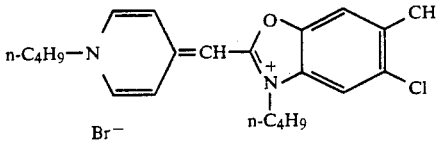
7.
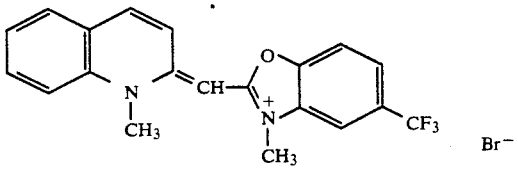
8.
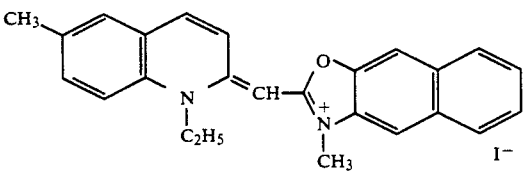
9.
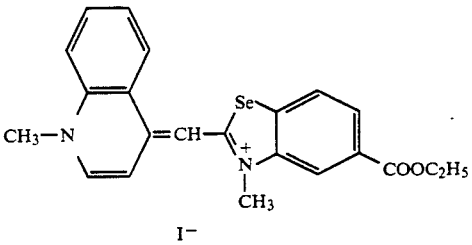
10.
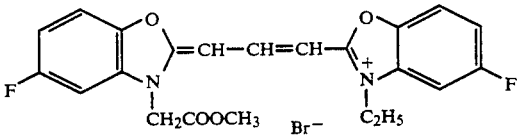
11.
12.
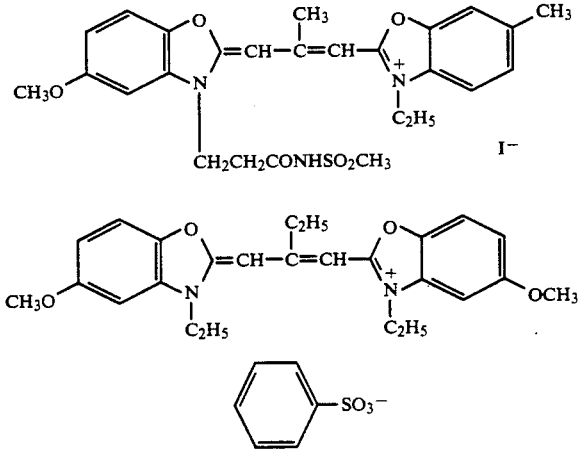
13.

-continued
14.
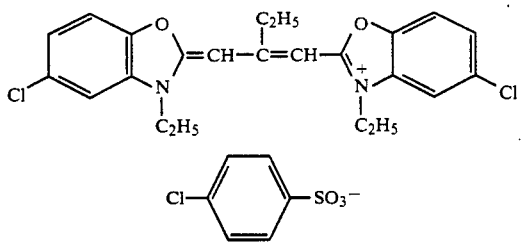
15.
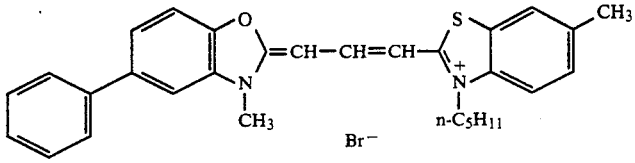
16.
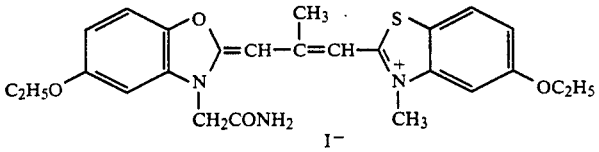
17.
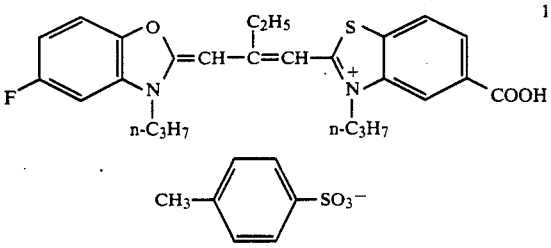
18.
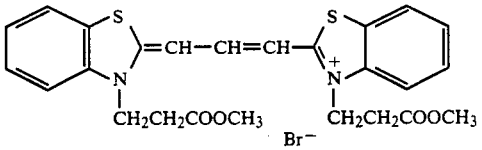
19.
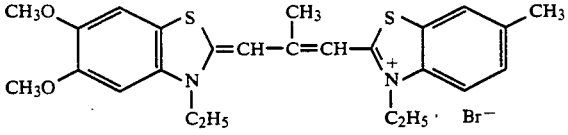
20.
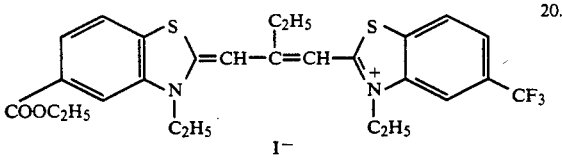
21.
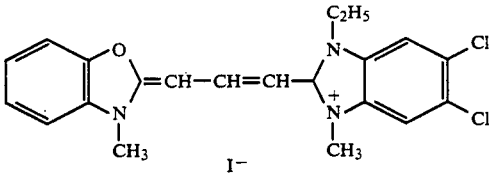
22.
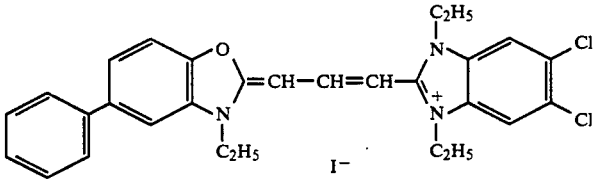
23.
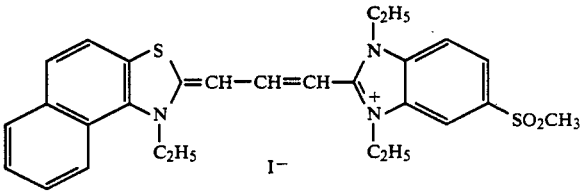

-continued
24.
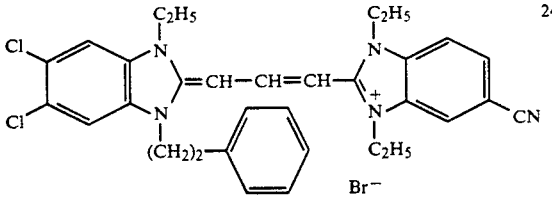
25.
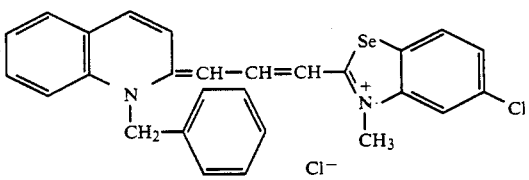
26.
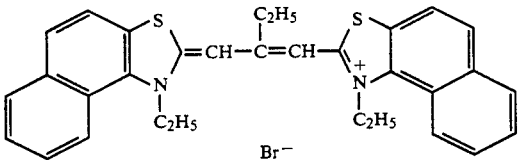
27.
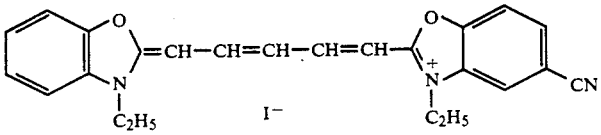
28.
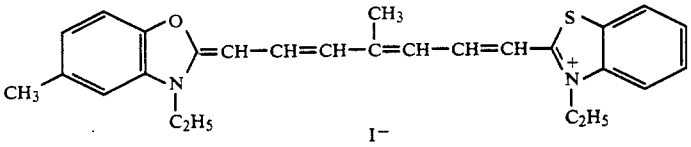
29.
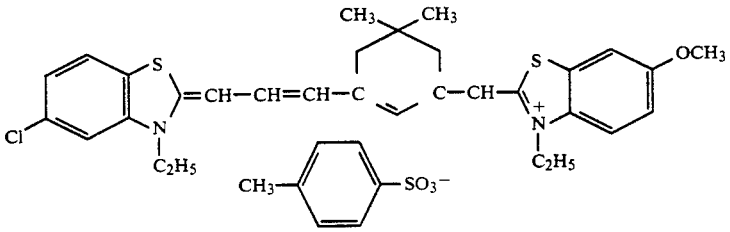
30.
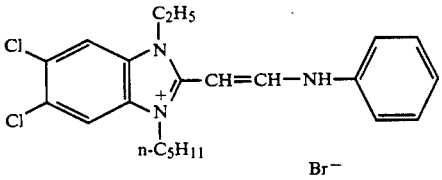
31.
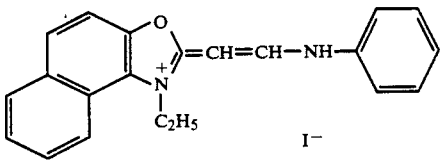
32.
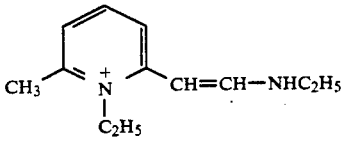
33.
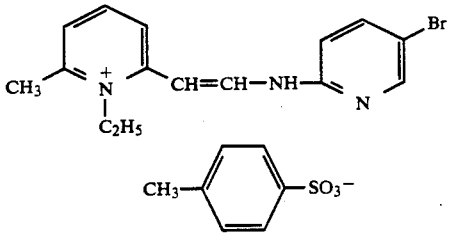
34.
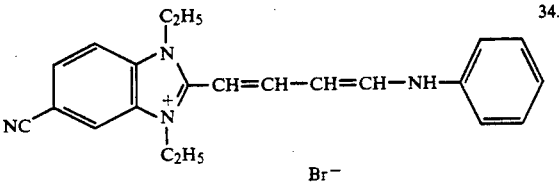
35.
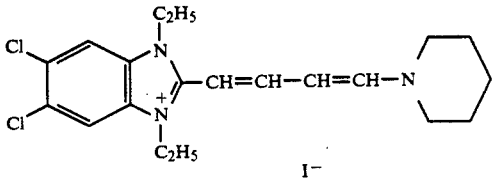

-continued
36.
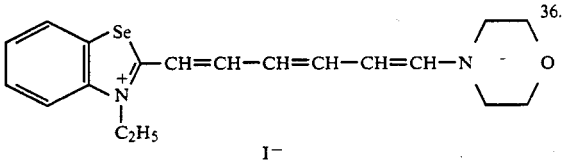
37.
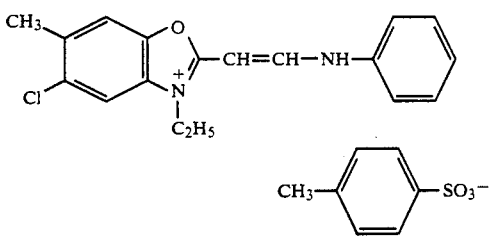
38.
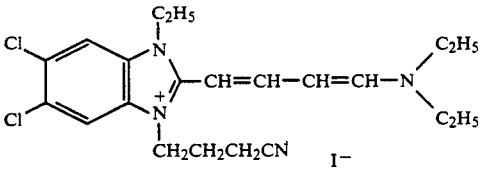
39.
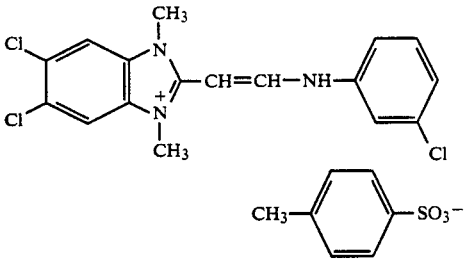
40.
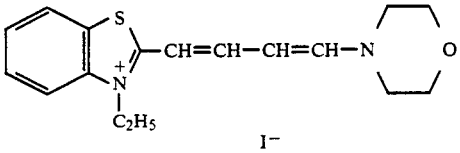
41.
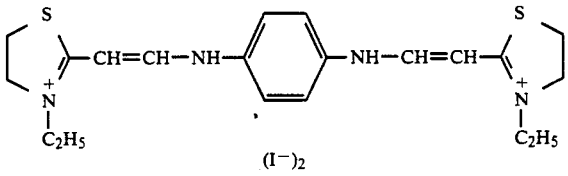
42.
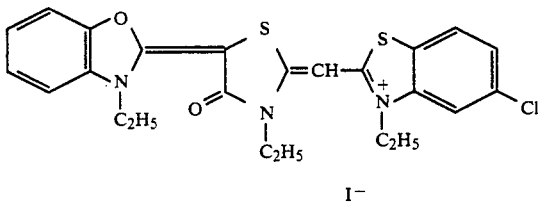
43.
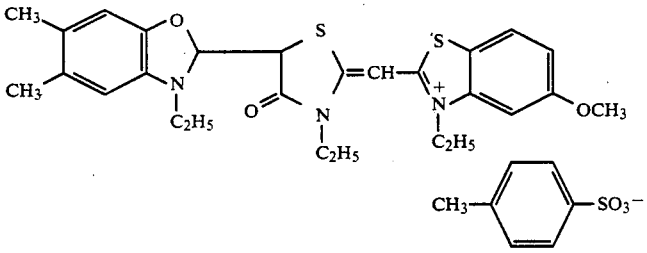
44.
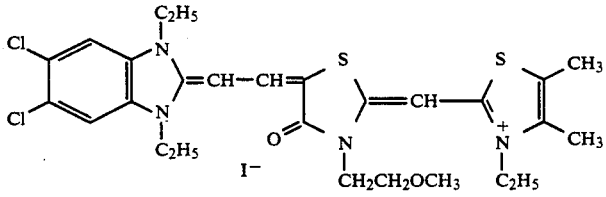
45.
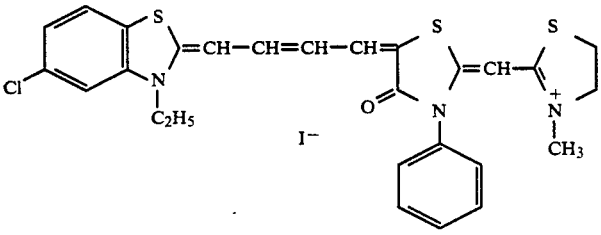

-continued

46.

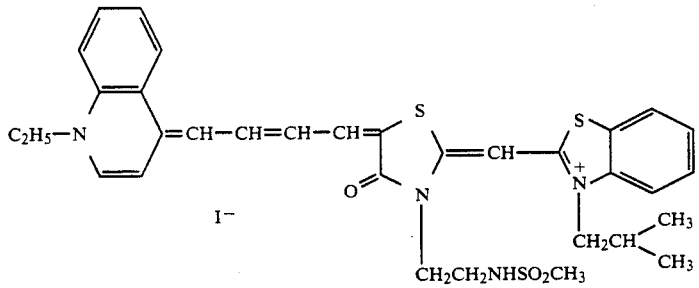

47.

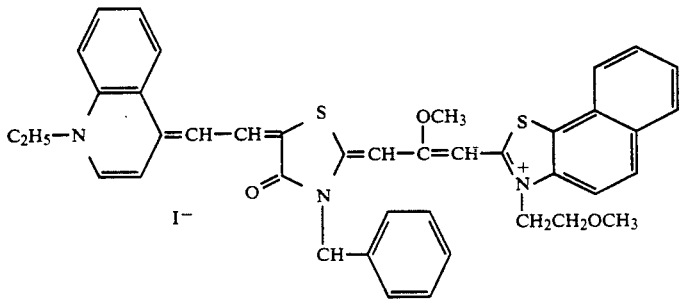

48.

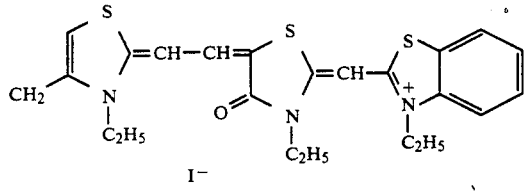

49.

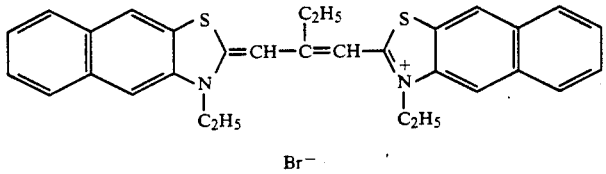

When the compound shown by formula (I) the hydrazine derivative shown by formula (II), and the cathionic dye shown by formulae (III), (IV) and (V) are incorporated in the photographic light-sensitive material of the present invention, it is preferred to incorporate them in a silver halide emulsion layer, but they may be incorporated in a light-insensitive hydrophilic colloid layer (e.g., a protective layer, an interlayer, a filter layer, and as antihalation layer).

Practically, if the compound being used is water-soluble, the compound may be added to an emulsion or a hydrophilic colloid solution as an aqueous solution thereof. If the compound is sparingly soluble in water, the compound may be added thereto as a solution in a water-miscible organic solvent such as alcohols, esters, or ketones, e.g., methanol, ethanol, propanol, fluorinated alcohol, acetone, methyl ethyl ketone, dimethylformamide, tetrahydrofuran, and methyl cellosolve.

When these compounds are incorporated in a silver halide emulsion layer, they may be added to the emulsion at any time after the initiation of chemical ripening and before coating, but is preferably added thereto between the finish of chemical ripening and before coating. In particular, it is preferred that the compounds are added to a coating composition prepared for coating.

It is preferred that the content of the compound for use shown by formula (I) is selected according to the grain size and the halogen composition of the silver halide emulsion, the method and the extent of the chemical sensitization being employed for the emulsion, the relation between the layer in which the compound is incorporated and a silver halide emulsion, and the nature of an antifoggant being used. The amount of the compound is preferably from $10^{-6}$ to $10^{-2}$ mol, and more preferably from $10^{-5}$ to $5\times10^{-3}$ mol per mol of silver halide.

The hydrazine derivative for use in the present invention shown by formula (II) can be added to an emulsion or other hydrophilic colloid solution by the same manner as the case of adding the compound of formula (I) described above and the amount thereof is preferably from $10^{-6}$ to $10^{-1}$ mol, and particularly preferably from $10^{-5}$ to $4\times10^{-3}$ mol per mol of silver halide.

The cationic dyes may be used singly or as a combination thereof. There is no particular restriction on the amount of the dye(s), but the amount is preferably from $10^{-7}$ to $10^{-2}$ mol, and particularly preferably from $10^{-6}$ to $10^{-3}$ mol per mol of silver halide.

The silver halide emulsion for use in the present invention may contain silver chloride, silver chlorobromide, silver iodobromide, silver iodochlorobromide, etc., but a silver halide composed of more than 70%, and particularly more than 90% silver bromide is preferred. The content of silver iodide is preferably less than 10 mol%, and particularly preferable from 0.1 to 5 mol%.

The silver halide grains for use in the present invention are preferably fine grains having a mean grain size of less than 0.7 μm, in particular less than 0.5 μm.

Also, there is no restriction on the grain size distribution of the silver halide emulsion for use in the present invention, but a mono-dispersed emulsion is preferred. A mono-dispersed silver halide emulsion is an emulsion composed of silver halide grains at least 95% by weight or number, of which are within ±40% of the mean grain size.

The silver halide grains in the photographic emulsion for use in the present invention may have a regular crystal form such as cubic, octahedral, etc., an irregular crystal form such as spherical, tabular, etc., or may be a composite form of these crystal forms.

The silver halide grains may be composed of a uniform phase or different phases between the inside and the surface portion thereof. Furthermore, two or more kinds of silver halide emulsions separately prepared may be used as a mixture thereof.

When two kinds of silver halide emulsions are used in the present invention, to increase the $D_{max}$ it is preferable to use two kinds of mono-dispersed silver halide emulsions each having a different mean grain size as disclosed in JP-A Nos. 61-223734 and 62-90646. In this case, the mono-dispersed emulsion having small grain size is preferably chemically sensitized, and most preferably sulfur-sensitized. The mono-dispersed emulsion having large grain size may or may not be chemically sensitized. That is, since the mono-dispersed emulsion of large grain size is liable to cause black peppers, the emulsion is not generally chemically sensitized or if the emulsion is chemically sensitized, it is particularly preferred to "shallowly" apply the chemical sensitization to an extent of not causing black peppers. The "shallow" chemical sensitization can be applied by shortening the time of applying the chemical sensitization, lowering the temperature thereof, or reducing the addition amount of a chemical sensitizer as compared to the case of chemically sensitizing the mono-dispersed emulsion of small size.

There is no restriction on the sensitivity difference between the mono-dispersed emulsion of large grain size and the mono-dispersed emulsion of small grain size but the sensitivity difference is preferably from 0.1 to 1.0, and more preferably from 0.2 to 0.7 as ΔlogE (E: an exposure amount). In this case the sensitivity is preferably higher in the mono-dispersed emulsion of large grain size.

Also, a silver halide emulsion layer may be composed of a single layer or multilayers (two layer, three layer, etc.). In the case of multilayers, the emulsion layers may be composed of a same kind of silver halide emulsion or different kinds of silver halide emulsions.

In the case of preparing the silver halide emulsion for use in the present invention, a cadmium salt, a sulfite, a lead salt, a thallium salt, a rhodium salt or a complex salt thereof, an iridium salt or a complex salt thereof, may exist during the formation or physical ripening of the silver halide grains.

A silver halide particularly suitable for use in the present invention is a silver halo-iodide prepared in the presence of an iridium salt or a complex salt thereof of from $10^{-8}$ to $10^{-5}$ mol per mol of silver, wherein the silver halide content at the surface of the grain is larger than the mean silver iodide content of the grain. By using the emulsion containing such a silver halo-iodide, the photographic characteristics of higher sensitivity and gamma can be obtained.

In the aforesaid case it is preferred to add an iridium salt to the emulsion in the amount as described above before finishing the physical ripening, in particular dye formation of silver halide grains in the production step of the silver halide emulsion.

The iridium salt which is used in the aforesaid case is a water-soluble iridium salt or iridium complex salt, such as iridium trichloride, iridium tetrachloride, potassium hexachloroiridate(III), potassium hexachloroiridate(IV), or ammonium hexachloroiridate (III).

Gelatin is advantageously used as the binder or protective colloid for the silver halide photographic emulsions for use in the present invention, but other hydrophilic colloids can be used. For example, there are gelatin derivatives, graft polymers of gelatin and other polymers, proteins such as albumin, and casein; cellulose derivatives such as hydroxyethyl cellulose, carboxymethyl cellulose, and cellulose sulfate esters; saccharose derivatives such as sodium alginate, and starch derivatives; and various synthetic polymers or copolymers such as polyvinyl alcohol, polyvinyl alcohol partial acetal, poly-N-vinylpyrrolidone, polyacrylic acid, polymethacrylic acid, polyacrylamide, polyvinyl imidazole, and polyvinyl pyrazole.

The silver halide emulsions for use in the present invention may be chemically sensitized. Suitable chemical sensitization method, for silver halide emulsions, a sulfur sensitization method, a reduction sensitization method and a noble metal sensitization method are known. Further, they can be used solely or as a combination thereof.

In the noble metal sensitization method, a gold sensitization is typical and a gold compound, mainly a gold complex is used. In other noble metal sensitization, a complex salt of a noble metal other than gold, such as platinum, palladium, or rhodium is used.

For the sulfur sensitization, sulfur compounds contained in gelatin as well as various sulfur compounds such as thiosulfates, thioureas, thiazoles, and rhodanines can be used as the sensitizer.

Also, for the reduction sensitization, stannous salts, amines, formamidinesulfinic acid, and silane compounds can be used.

The photographic light-sensitive materials of the present invention may contain the compounds described in JP-A Nos. 60-140340 and 61-167939 for increasing sensitivity and contrast. They may be used singly or in combination.

Furthermore, the photographic light-sensitive materials of the present invention may contain various compounds for preventing the formation of fog during the production, storage, and photographic processing of the photographic materials or stabilizing the photographic performance thereof. Examples thereof are compounds known as antifoggants or stabilizers, e.g., azoles such as benzothiazoliums, nitroindazoles, chlorobenzimidazoles, bromobenzimidazoles, mercaptothiazoles, mercaptobenzothiazoles, mercaptothiazoles, aminotriazoles, benzothiazoles, and nitrobenzotriazoles; mercaptopyrimidines; mercaptotriazines; thioketo compounds such as oxazolinethione; azaindenes such as triazaindenes, tetraazaindenes (in particular, 4-hydroxy-substituted (1,3,3a,7)tetraazaindenes), and pentaazaindenes; benzenethiosulfonic acid; benzenesulfonic acid; and benzenesulfonic acid amide.

In these compounds, benzotriazoles (e.g., 5-methylbenzotriazole) and nitroindazoles (e.g., 5-nitroindazole) are preferred.

The aforesaid compounds may be added to processing solutions.

The photographic light-sensitive materials of the present invention may contain an inorganic or organic hardening agent, such as chromium salts (e.g., chromium alum), aldehydes (e.g., formaldehyde), N-methylol compounds (e.g., dimethylolurea), dioxane derivatives, active vinyl compounds (e.g., 1,3,5-triacryloyl-hexahydro-s-triazine, 1,3-vinylsulfonyl-2-propanol), active halogen compounds (e.g., 2,4-dichloro-6-hydroxy-s-triazine), mucohalogenic acids (e.g., mucohloric acid, mucophenoxychloric acid), etc. They can be used singly or in combination.

The photographic light-sensitive materials of the present invention may contain various surface active agents for various purposes including; as a coating aid, static prevention, slidability improvement, improvement of emulsified dispersion, sticking prevention, and improvement photographic characteristics (e.g., development acceleration, contrast increase, and sensitization).

Examples of such surface active agents are nonionic surface active agents such as saponin (steroyd series), alkylene oxide derivatives (e.g., polyethylene glycol, a polyethylene glycol/polypropylene glycol condensate, polyethylene glycol alkyl ethers, polyethylene glycol alkylaryl ethers, polyethylene glycol esters, polyethylene glycol sorbtan esters, polyalkylene glycol alkylamines polyalkylene glycol alkylamides, and polyethylene oxide addition products of silicone), glycidol derivatives (e.g., alkenylsuccinic polyglyceride and alkylphenol polyglyceride), fatty acid esters of polyhydric alcohols, and alkyl esters of saccharode; anionic surface active agents containing acid groups (e.g., carboxy, sulfo, phospho, sulfuric ester, and phosphoric acid ester), such as alkylcarboxylates, alkylsulfonates, alkylbenzenesulfonates, alkylnaphthalenesulfonates, alkylsulfuric acid esters, alkylphosphoric acid esters, N-acyl-N-alkyltuarines, sulfosuccinic acid esters, sulfoalkyl polyoxyethylene alkylphenyl ethers, and polyoxyethylene alkylphosphoric acid esters; amphoteric surface active agents such as amino acids, aminoalkylsulfonic acids, aminoalkylsulfuric acids, aminoalkylphosphoric acid esters, alkylbetaines, and amine oxides; and cationic surface active agents such as alkylamine salts, aliphatic or aromatic quaternary ammonium salts, heterocyclic quaternary ammonium salts (e.g., pyridiniums and imidazoliums), and phosphonium or sulfonium salts containing an aliphatic ring or a heterocyclic ring.

In particular, the polyalkylene oxides having a molecular weight of rom 600 to 30,000 described in JP-B No. 58-9412 are preferably used in the present invention. (The term "JP-B" as used herein means an "examined Japanese patent publication").

The photographic silver halide materials of the present invention can further contain in the silver halide emulsion layers or other hydrophilic colloid layers, a matting agent such as silica, magnesium oxide, or polymethyl methacrylate particles, for the purpose of preventing sticking.

Also, the photographic light-sensitive materials of the present invention can contain a dispersion of a water-soluble or water sparingly soluble synthetic polymer for the improvement of dimensional stability. Examples of such a polymer are polymers composed of alkyl acrylate or methacrylate (hereafter collectively referred to as "(meth)acrylate"), alkoxyalkyl (meth)acrylate, glycidyl (meth)acrylate, (meth)acrylamide, a vinyl ester (e.g., vinyl acetate), acrylonitrile, olefin, and styrene, alone or in combination, or a combination of the aforesaid monomer and acrylic acid, methacrylic acid, $\alpha,\beta$-unsaturated dicarboxylic acid, hydroxyalkyl (meth)acrylate, sulfoalkyl (meth)acrylate, or styrenesulfonic acid.

Suitable support for the photographic materials of the present invention, include films of cellulose triacetate, cellulose diacetate, nitrocellulose, polystyrene, and polyethylene terephthalate, but a polyethylene terephthalate film is most preferred.

The support may be subjected to corona discharging treatment and, if necessary, the support may be subjected to subbing treatment.

Also, for increasing the so-called dimentional stability (preventing dimension changes due to temperature and/or humidity fluctuations) of the photographic light-sensitive material, a waterproofing layer containing a polyvinylidene chloride series polymer may be formed thereon.

Suitable development accelerators or accelerators for a nucleating infectious development, that can be used for the photographic light-sensitive materials of the present invention, include the compounds disclosed in JP-A No. 53-77,616, 54-37732, 53-137133, 60-140340 and 60-14959 as well as other various compounds containing nitrogen atoms or sulfur atom.

The optimum amount of accelerator differs according to the kind of the compound but it is desirable that the amount thereof is from $10^{-3}$ to 0.5 g/m$^2$, and preferably from $5.0\times10^{-3}$ to 0.1 g/m$^2$. The accelerator is added to a coating composition for the photographic light-sensitive material of the present invention as a solution in a proper solvent such as water, alcohols (e.g., methanol and ethanol), acetone, dimethylformamide, or methyl cellosolve.

Specific examples of these accelerators are illustrated below.

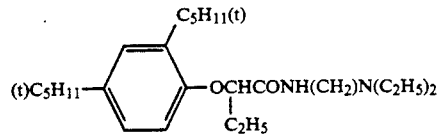

-continued
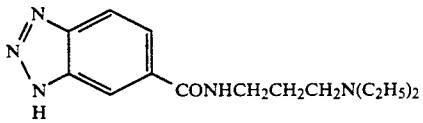
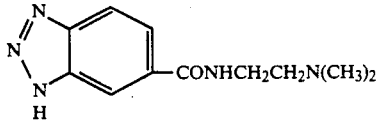
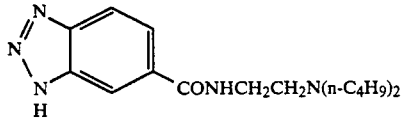
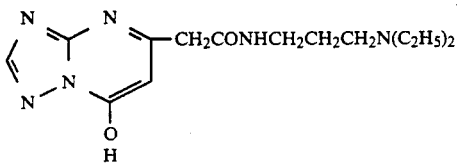
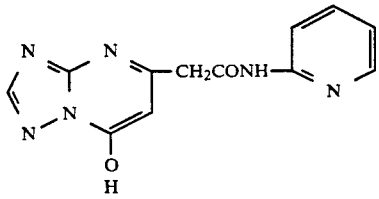
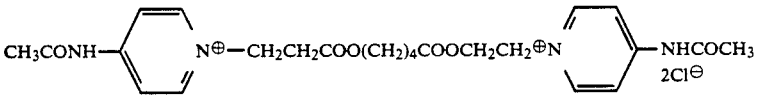
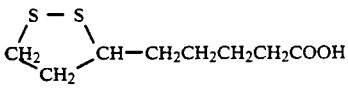
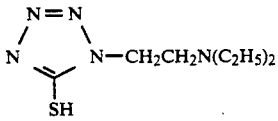
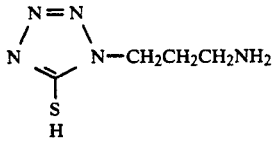
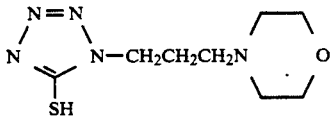
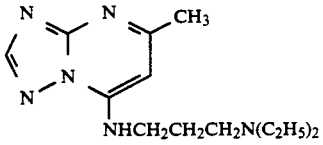

-continued

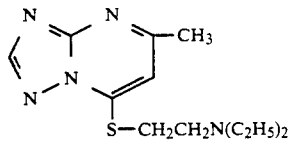

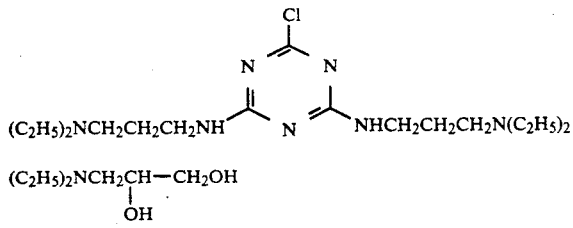

$(C_2H_5)_2NCH_2CH(OH)-CH_2OH$ $n\text{-}C_4H_9N(C_2H_4OH)_2$

It is preferred that the photographic light-sensitive material of the present invention further contains 0.05 to 3 g/m$^2$ of a compound having an acid group in the silver halide emulsion layer or other hydrophilic colloid layer. Examples of compounds having an acid group are organic acids such as salicyclic acid, acetic acid, and ascorbic acid, and polymers or copolymers having an acid monomer such as acrylic acid, maleic acid, and phthalic acid, as a recurring unit. These compounds are described in JP-A No. 61-223834, 61-228437, 62-25745, 62-55642, and 62-220947. In these compounds, ascorbic acid is particularly preferred as the low molecular weight compound and a water-dispersing latex of a copolymer composed of an acid monomer such as acrylic acid and a crosslinking monomer having two or more unsaturated groups, such as divinylbenzene is particularly preferred as the high molecular weight compound.

For obtaining the photographic characteristics of super-high contrast and high sensitivity using the silver halide photographic materials of the present invention, a stable developer can be used without the need to use a conventional infectious developer or a high-alkaline developer having pH of about 13 as described in U.S. Pat. No. 2,419,975.

That is, the silver halide photographic material of the present invention produces negative images of sufficiently high contrast by using a developer containing 0.15 mol/liter or more sulfate ions as a preservative and having pH of from 10.5 to 12.3, and particularly from 11.0 to 12.0.

There is no restriction on the developing agent which is used for the developer for developing the photographic materials of the present invention, but it is preferred, to obtain good dot image quality, that the developer contains a dihydroxybenzene. As the case may be, a combination of a dihydroxybenzene and a 1-phenyl-3-pyrazolidone or a combination of a dihydroxybenzene and a p-aminophenol is used.

Examples of the dihydroxybenzene developing agent for use in the present invention are hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone, but hydroquinone is particularly preferred.

Examples of 1-phenyl-3-pyrazolidone or the derivative thereof as the developing agent for use in the present invention are 1-phenyl-3-pyrazolidone, 1-phenyl-4,4-dimethyl-4-pyrazolidone, 1-phenyl-4-methyl-4-hydroxymethyl- 3-pyrazolidone, 1-phenyl-4,4-dihydroxymethyl-3-pyrazolidone, 1-pheyl-5-methyl-3-pyrazolidone, 1-p-aminophenyl-4,4-dimethyl-3-pyrazolidone, and 1-p-tolyl-4,4-dimethyl-3-pyrazolidone.

Also, examples of the p-aminophenol series developing agent for use in the present invention are N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol. Of these compounds, N-methyl-p-aminophenol is preferred.

The developing agent is preferably used in an amount of from 0.05 mol/liter to 0.8 mol/liter. Also, in the case of using a combination of the dihydroxybenzene and the 1-pheyl-3-pyrazolidone or the p-aminophenol, it is preferred that the former is used in an amount of from 0.05 mol/liter to 0.5 mol/liter and the latter is used in an amount of less than 0.06 mol/liter.

Examples of the sulfite which is used as a preservative for the developer in this invention are sodium sulfite, potassium sulfite, lithium sulfite, ammonium sulfite, sodium hydrogensulfite, potassium metahydrogensulfite, and sodium formaldehyde hydrogensulfite.

The sulfite is used in an amount of, preferably, at least 0.4 mol/liter, and particularly preferably, at least 0.5 mol/liter. Also, the upper limit of the sulfite is preferably 2.5 mol/liter.

For adjusting the pH of the developer, an alkali agent is used. Examples of alkali pH controlling agents and buffers include sodium hydroxide, potassium hydroxide, sodium carbonate, potassium carbonate, sodium tertiary phosphate, and potassium tertiary phosphate. The pH of the developer is adjusted to between 10.5 and 12.3.

The developer may further contain, in addition to the aforesaid components, other additives as development inhibitors such as boric acid, borax, sodium bromide, potassium bromide, and potassium iodide; an organic solvent such as ethylene glycol, diethylene glycol, triethylene glycol, dimethylformamide, methylcellosolve, hexylene glycol, and ethanol, methanol; and an antifoggant or a black pepper preventing agent such as indazole series compounds (e.g., 1-phenyl-5-mercaptotetrazole and 5-nitroindazole), and benztriazole series compounds (e.g., 5-methylbenztriazole).

Furthermore, if necessary, the developer may contain a toning agent, a surface active agent, a defoaming agent, a water softener, a hardening agent, and the amino compound described in JP-A No. 56-106244.

Also, the developer for use in the present invention may include the silver stain preventing agent described in JP-A No. 56-24347.

Furthermore, the dissolution aid described in JP-A No. 61-267759 may be included in the present developer.

Moreover, suitable pH buffers for use with the present developer are described in JP-A No. 60-93433 and in JP-A No. 62-186259.

The photographic light sensitive material of the present invention may be fixed in any known fix solution after development. As the fixing agent, thiosulfates and thiocyanates as well as organic sulfur compounds which are known fixing agents, can be used.

The fix solution may contain a water soluble aluminum compound (e.g., aluminum sulfate and aluminum alum) as a hardening agent. The amount of the water-soluble aluminum compound is usually from 0.4 to 2.0 g-Al/liter. Furthermore, a complex agent of ethylenediaminetetraacetic acid and a trivalent iron compound, can be used as an oxidizing agent.

The processing temperature is usually selected from 18° C. to 50° C., and preferably from 25° C. to 43° C.

The following examples further illustrate the present invention in detail, but are not to be construed to limit the scope thereof.

| Developer Composition | |
|---|---|
| Hydroquinone | 45.0 g |
| N-Methyl-p-aminophenol ½sulfate | 0.8 g |
| Sodium hydroxide | 18.0 g |
| Potassium hydroxide | 55.0 g |
| 5-Sulfosalicylic acid | 45.0 g |
| Boric acid | 25.0 g |
| Potassium sulfite | 110.0 g |
| Ethylenediaminetetraacetic acid di-sodium salt | 1.0 g |
| Potassium bromide | 6.0 g |
| 5-Methylbenzotriazole | 0.6 g |
| n-Butyldiethanolamine | 15.0 g |
| Water to make | 1 liter (pH 11.6) |

The development time and temperature were 34° C. and 30 seconds. In addition, for the evaluation of the formation of black peppers, the development was carried out under forced conditions for 40 seconds at 34° C.

COMPARATIVE EXAMPLE 1

To an aqueous gelatin solution kept at 50° C. were simultaneously added an aqueous solution of silver nitrate and an aqueous solution of potassium iodide and potassium bromide in the presence of $4\times10^{-7}$ mol of potassium hexachloroiridate(IV) per mol of silver and ammonium over a period of 60 minutes while keeping pAg at 7.8 to provide a mono-dispersed emulsion containing cubic silver iodobromide grains having a mean grain size of 0.25 μm and a mean silver iodide content of 1 mol%.

To the silver iodobromide emulsion were added $3.0\times10^{-4}$ mol of the sodium salt of 5,5'-dichloro-9-ethyl-3,3'-bis(3-sulfopropyl)oxacarbocyanine per mol of silver as a sensitizing dye for orthochromatic sensitization and the cationic dye in this invention for panchromatic sensitization as shown in Table 1 below.

Furthermore, after adding thereto 4-hydroxy-6-methyl-1,3,3a,7-tetraazaindene, polyethyl acrylate latex, polyethylene glycol, 1,3-vinylsulfonyl-2-propanol, 1-phenyl-5-mercaptotetrazole, and 1,4-bis[3-(4-acetylaminopyridino)propionyloxy]tetramethylene dibromide as stabilizers and also the hydrazine derivative II-30 in an amount of $3.0\times10^{-3}$ mol per mol of silver, the emulsion was coated on a polyethylene terephthalate film of 100 μm thick at a silver coverage of 3.4 g/m$^2$. The gelatin coverage was 3.2 g/m$^2$.

On the emulsion layer was simultaneously coated a layer containing 1.3 g/m$^2$ of gelatin, 50 mg/m$^2$ of polymethyl methacrylate particles having a mean grain size of 2.5 μm, and, as coating aids, the fluorine series surface active agent having the structure shown below and sodium dodecylbenzenesulfonate as a protective layer to provide a comparative sample.

$$C_8F_{17}SO_2\underset{\underset{C_3H_7}{|}}{N}CH_2COOK$$

EXAMPLE 1

By following the same procedure as Comparative Example 1 while adding each of the compounds shown by formula (I) for use in this invention to the silver halide emulsion layer as shown in Table 1, each of the samples of this invention was prepared.

Evaluation of Photographic Performance

Each of the comparison samples and the samples of the present invention prepared as above were light-exposed and developed. The results are shown in Table 1.

The evaluations shown in Table 1 were carried out as follows.

(1) The relative sensitivity was shown by the relative value of the reciprocal of the exposure amount giving the density 1.5 with the value of Comparative Sample-a as being 100.

(2) The black pepper was evaluated by magnifying the field of view of about 4 mm in diameter 25 times by a microscopic observation and counting the number of black peppers. Thus, less the numerical value, less the formation of black pepper.

TABLE 1

| | Cationic Dye | | Compound of Formula (I) | | Photographic Properties | | | Black |
|---|---|---|---|---|---|---|---|---|
| Sample No. | Kind | Amount (mol/Ag ml) | Kind | Amount (mol/Ag mol) | Sensitivity | Contrast (γ) | Dmax | Pepper (number) |
| 1 Comparative Sample-a | Compound 26 | $4.0\times10^{-5}$ | — | — | 100 | 13 | 3.7 | 57 |
| 2 Comparative Sample-b | Compound 26 | $6.0\times10^{-5}$ | — | — | 110 | 15 | 4.0 | 105 |
| 3 Comparative Sample-c | Compound 49 | $4.0\times10^{-5}$ | — | — | 97 | 14 | 3.9 | 71 |
| 4 Comparative Sample-d | Compound 49 | $6.0\times10^{-5}$ | — | — | 101 | 16 | 4.1 | 140 |

TABLE 1-continued

| Sample No. | Cationic Dye Kind | Cationic Dye Amount (mol/Ag ml) | Compound of Formula (I) Kind | Compound of Formula (I) Amount (mol/Ag mol) | Photographic Properties Sensitivity | Photographic Properties Contrast (γ) | Photographic Properties Dmax | Black Pepper (number) |
|---|---|---|---|---|---|---|---|---|
| 5 Sample-1-1 | Compound 26 | $4.0 \times 10^{-5}$ | I-3 | $2.0 \times 10^{-4}$ | 99 | 13 | 3.8 | 18 |
| 6 Sample-1-2 | Compound 26 | $4.0 \times 10^{-5}$ | I-3 | $4.0 \times 10^{-4}$ | 97 | 12 | 3.6 | 7 |
| 7 Sample-1-3 | Compound 26 | $4.0 \times 10^{-5}$ | I-10 | $2.0 \times 10^{-4}$ | 98 | 13 | 3.9 | 15 |
| 8 Sample-1-4 | Compound 26 | $4.0 \times 10^{-5}$ | I-10 | $4.0 \times 10^{-4}$ | 97 | 13 | 3.7 | 4 |
| 9 Sample-1-5 | Compound 26 | $4.0 \times 10^{-5}$ | I-26 | $2.0 \times 10^{-4}$ | 96 | 12 | 3.6 | 21 |
| 10 Sample-1-6 | Compound 26 | $4.0 \times 10^{-5}$ | I-26 | $4.0 \times 10^{-4}$ | 94 | 11 | 3.4 | 11 |
| 11 Sample-1-7 | Compound 26 | $6.0 \times 10^{-5}$ | I-10 | $2.0 \times 10^{-4}$ | 109 | 14 | 4.1 | 23 |
| 12 Sample-1-8 | Compound 26 | $6.0 \times 10^{-5}$ | I-10 | $4.0 \times 10^{-4}$ | 101 | 13 | 3.9 | 6 |
| 13 Sample-1-9 | Compound 49 | $4.0 \times 10^{-5}$ | I-3 | $2.0 \times 10^{-4}$ | 96 | 13 | 4.0 | 34 |
| 14 Sample-1-10 | Compound 49 | $4.0 \times 10^{-5}$ | I-3 | $4.0 \times 10^{-4}$ | 94 | 12 | 3.8 | 13 |
| 15 Sample-1-11 | Compound 49 | $4.0 \times 10^{-5}$ | I-10 | $2.0 \times 10^{-4}$ | 96 | 14 | 4.2 | 27 |
| 16 Sample-1-12 | Compound 49 | $4.0 \times 10^{-5}$ | I-10 | $4.0 \times 10^{-4}$ | 95 | 13 | 4.0 | 9 |
| 17 Sample-1-13 | Compound 49 | $4.0 \times 10^{-5}$ | I-26 | $2.0 \times 10^{-4}$ | 94 | 12 | 3.7 | 36 |
| 18 Sample-1-14 | Compound 49 | $4.0 \times 10^{-5}$ | I-26 | $4.0 \times 10^{-4}$ | 92 | 11 | 3.5 | 17 |
| 19 Sample-1-15 | Compound 49 | $6.0 \times 10^{-5}$ | I-10 | $2.0 \times 10^{-4}$ | 98 | 16 | 4.3 | 35 |
| 20 Sample-1-16 | Compound 49 | $6.0 \times 10^{-5}$ | I-10 | $4.0 \times 10^{-4}$ | 94 | 15 | 4.1 | 15 |

From the results shown in Table 1 above, it can be see that the samples of this invention give greatly less black peppers as compared with the comparative samples. Also, the sensitivity, the gradation (γ), and the maximum density ($D_{max}$) of images were substantially the same between the comparative samples and the samples of this invention.

EXAMPLE 2

By following the same procedure as Comparative Example 1 except that II-33 was used in place of II-30 as the hydrazine derivative in an amount of $2.5 \times 10^{-4}$ mol per mol of silver, comparative samples (e) and (f) were prepared. The samples of the present invention were prepared by following the same procedure as Example 1 except that II-33 was used as above in place of II-30. Further, each of the cationic dyes and the compounds of formula (I) were used as shown in Table 2.

The photographic performance of each sample was evaluated as in Example 1 and the results obtained are shown in Table 2 below.

The results show that the samples of this invention give greatly less black peppers as compared with the comparative samples without substantially changing the sensitivity, contrast and $D_{max}$.

TABLE 2

| Sample No. | Cationic Dye Kind | Cationic Dye Amount (mol/Ag ml) | Compound of Formula (I) Kind | Compound of Formula (I) Amount (mol/Ag mol) | Photographic Properties Sensitivity | Photographic Properties Contrast (γ) | Photographic Properties Dmax | Black Pepper (number) |
|---|---|---|---|---|---|---|---|---|
| 1 Comparative Sample-e | Compound 26 | $4.0 \times 10^{-5}$ | — | — | 107 | 18 | 3.9 | 75 |
| 2 Comparative Sample-f | Compound 49 | $4.0 \times 10^{-5}$ | — | — | 114 | 20 | 4.3 | 96 |
| 3 Sample-2-1 | Compound 26 | $4.0 \times 10^{-5}$ | I-3 | $4.0 \times 10^{-4}$ | 107 | 18 | 4.1 | 17 |
| 4 Sample-2-2 | Compound 26 | $4.0 \times 10^{-5}$ | I-3 | $6.0 \times 10^{-4}$ | 105 | 17 | 3.8 | 8 |
| 5 Sample-2-3 | Compound 26 | $4.0 \times 10^{-5}$ | I-10 | $4.0 \times 10^{-4}$ | 106 | 18 | 4.2 | 12 |
| 6 Sample-2-4 | Compound 26 | $4.0 \times 10^{-5}$ | I-10 | $6.0 \times 10^{-4}$ | 104 | 15 | 3.8 | 5 |
| 7 Sample-2-5 | Compound 26 | $4.0 \times 10^{-5}$ | I-15 | $4.0 \times 10^{-4}$ | 105 | 16 | 4.0 | 19 |
| 8 Sample-2-6 | Compound 26 | $4.0 \times 10^{-5}$ | I-15 | $6.0 \times 10^{-4}$ | 102 | 14 | 3.7 | 9 |
| 9 Sample-2-7 | Compound 49 | $4.0 \times 10^{-5}$ | I-3 | $4.0 \times 10^{-4}$ | 113 | 19 | 4.4 | 21 |
| 10 Sample-2-8 | Compound 49 | $4.0 \times 10^{-5}$ | I-3 | $6.0 \times 10^{-4}$ | 112 | 18 | 4.1 | 14 |
| 11 Sample-2-9 | Compound | $4.0 \times 10^{-5}$ | I-10 | $4.0 \times 10^{-4}$ | 112 | 19 | 4.5 | 15 |

TABLE 2-continued

| Sample No. | Cationic Dye Kind | Cationic Dye Amount (mol/Ag ml) | Compound of Formula (I) Kind | Compound of Formula (I) Amount (mol/Ag mol) | Photographic Properties Sensitivity | Photographic Properties Contrast (γ) | Photographic Properties Dmax | Black Pepper (number) |
|---|---|---|---|---|---|---|---|---|
| 12 Sample-2-10 | 49 Compound 49 | $4.0 \times 10^{-5}$ | I-10 | $6.0 \times 10^{-4}$ | 111 | 17 | 4.1 | 7 |
| 13 Sample-2-11 | 49 Compound 49 | $4.0 \times 10^{-5}$ | I-15 | $4.0 \times 10^{-4}$ | 109 | 18 | 4.2 | 23 |
| 14 Sample-2-12 | 49 Compound 49 | $4.0 \times 10^{-5}$ | I-15 | $6.0 \times 10^{-4}$ | 108 | 15 | 3.9 | 10 |

EXAMPLE 3

By following the same procedure as Example 2 (Sample 2–4) while further adding 18 mg/m$^2$ of the development accelerator shown below to the silver halide emulsion, a sample of the invention was prepared.

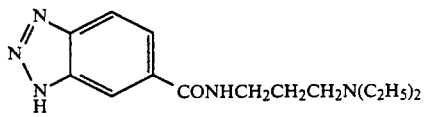

The photographic performance was evaluated as in Example 1. The results showed that the sensitivity, the gradation, and $D_{max}$ were 108, 21 and 4.4, respectively and the number of black peppers formed was 6.

EXAMPLE 4

By following the same procedure as Example 2 (Sample 2–4) except that the acid polymer latex shown below was added to the silver halide emulsion in an amount of 0.2 g/m$^2$ or 0.4 g/m$^2$, Samples 4-1 and 4-2 were prepared.

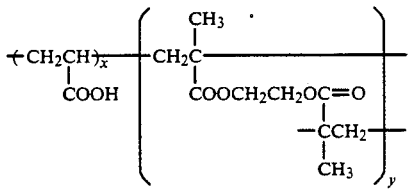

x:y = 50:50 (by mol)

On each of the samples thus prepared, the photographic performance was evaluated as in Example 2 and the results are shown in Table 3 below.

TABLE 3

| Sample No. | Photographic Performance Sens. | Photographic Performance Gradation | Photographic Performance Dmax | Black Pepper (number) |
|---|---|---|---|---|
| Sample 4-1 | 103 | 15 | 3.8 | 3 |
| Sample 4-2 | 101 | 14 | 3.8 | 1 |

As is clear from the above table, the formation of black pepper was extremely less in both the samples.

While the invention has been described in detail and with reference to specific embodiments thereof, it will be apparent to one skilled in the art that various changes and modifications can be made therein without departing from the spirit and scope thereof.

What is claimed is:

1. A negative silver halide photographic light-sensitive material comprising a support having thereon at least one silver halide emulsion layer, wherein said silver halide emulsion layer or another hydrophilic colloid layer provided on the support contains (i) a hydrazine derivative, (ii) at least one cationic dye selected from the group consisting of cyanine dyes, hemicyanine dyes and rhodacyanine dyes, and (iii) a compound represented by formula (I) and having substantially no absorption maximum in the visible region and thereby providing a residual color tone below a level causing no practical problem after development;

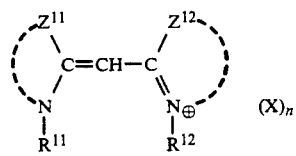

(I)

wherein $Z^{11}$ and $Z^{12}$ each represents a non-metallic atom necessary for forming a heterocyclic ring, with the ring being selected from the group consisting of a benzoxazole nucleus, a benzothiazole nucleus, a benzoselenazole nucleus, a naphthoxazole nucleus, a napthothiazole nucleus, a naphthoselenazole nucleus, a thiazole nucleus, a thiazoline nucleus, an oxazole nucleus, a selenazole nucleus, a selenazoline nucleus, a pyridine nucleus, a benzimidazole nucleus, and a quinoline nucleus; $R^{11}$ and $R^{12}$ each represents an unsubstituted or substituted alkyl group, each of $R^{11}$ and $R^{12}$ containing an acid group; X represents a charge balancing ion; and n represents 0 or 1.

2. A negative silver halide photographic light-sensitive material as claimed in claim 1, wherein said compound represented by formula (I) has an absorption maximum at the wavelength region of shorter than 460 nm.

3. A negative silver halide photographic light-sensitive material as claimed in claim 1, wherein said compound represented by formula (I) has an absorption maximum at the wavelength region of shorter than 430 nm.

4. A negative silver halide photographic light-sensitive material as claimed in claim 1, wherein said hydrazine derivative is represented by formula (II)

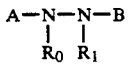

(II)

wherein A represents an aliphatic group or an aromatic group; B represents a formyl group, an acyl group, an alkylsulfonyl group, an arylsulfonyl group, an alkylsufinyl group, an arylsulfinyl group, a carbamoyl group, an alkoxycarbonyl group, an aryloxycarbonyl group, a sulfinamoyl group, an alkoxysulfonyl group, a thioacyl group, a thiocarbamoyl group, a sulfanyl group or a heterocyclic group; and $R_0$ and $R_1$ each represents a hydrogen atom, or one of $R_0$ and $R_1$ represents a hydrogen atom and the other represents a substituted or unsubstituted alkylsufonyl group, a substituted or unsubstituted arylsulfonyl group, or a substituted or unsubstituted acyl group; or B, $R_1$ and the nitrogen atom to which B and $R_1$ are bonded form a partial structure

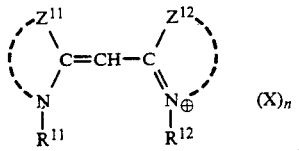

(I)

of hydrazone.

5. A negative silver halide photographic light-sensitive material as claimed in claim 1, wherein said cationic dye is represented by formula (III) or (IV)

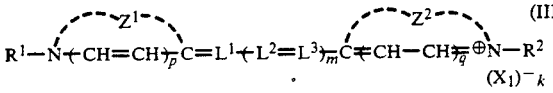

(III)

wherein $Z^1$ and $Z^2$, which may be the same or different, each represents an atomic group necessary for forming a 5- or 6-membered heterocyclic ring; $R^1$ and $R^2$, which may be the same or different, each represents an alkyl group or a substituted alkyl group; $L^1$, $L^2$, and $L^3$ each represents a methine group or a substituted methine group; p and q represent 0 or 1, and m represents 0, 1, 2, or 3, provided that p, q and m are not 0 at the same time; $X_1$ represents an anion; and k represents 0 or 1; and

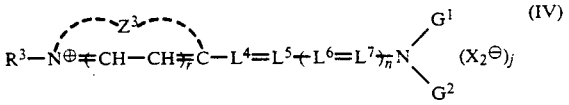

(IV)

wherein $Z^3$ has the same significance as $Z^1$ and $Z^2$; $R^3$ has the same significance as $R^1$ and $R^2$; $L^4$, $L^5$, $L^6$, and $L^7$ have the same significance as $L^1$, $L^2$, and $L^3$; r has the same significance as p and q; $X_2$ has the same significance as $X_1$; j has the same significance as k; n represents 0, 1 or 2; and $G^1$ and $G^2$, which may be the same or different, each represents a hydrogen atom, an alkyl group, a substituted alkyl group, an aryl group, or a substituted aryl group, or $G^1$ and $G^2$ together form a ring induced from a cyclic secondary amine.

6. A negative silver halide photographic light-sensitive material as claimed in claim 1, wherein said cationic dye is represented by formula (IV) or (V):

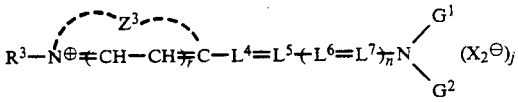

(IV)

wherein $Z^3$ represents an atomic group necessary for forming a 5- or 6-membered etherocyclic ring; $R^3$ represents an alkyl group or a substituted alkyl group; $L^4$, $L^5$, $L^6$ and $L^7$ each represents a methine group or a substituted methine group; r represents 0 or 1; n represents 0, 1 or 2; $X_2^-$ represents an anion; j represents 0 or 1; and $G^1$ and $G^2$, which may be the same or different, each represents a hydrogen atom, an alkyl group, a substituted alkyl group, an aryl group, or a substituted aryl group, or $G^1$ and $G^2$ together form a ring induced from a cyclic secondary amine; and

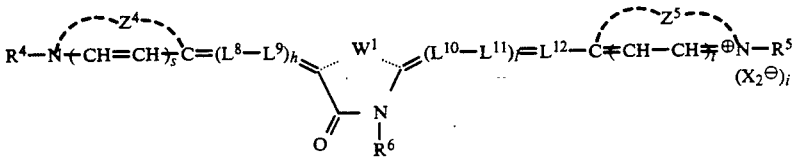

(V)

wherein $Z^4$ and $Z^5$ have the same significance as $Z^3$; $R^4$ and $R^5$ have the same significance as $R^3$; $R^6$ represents a hydrogen atom, an alkyl group, a substituted alkyl group, an aryl group, a substituted aryl group, or a heterocyclic group; $L^8$, $L^9$, $L^{10}$, $L^{11}$ and $L^{12}$ have the same significance as $L^4$, $L^5$, $L^6$ and $L^7$; $W^1$ represents an atomic group necessary for forming a 5- or 6-membered heterocyclic ring; h and l each represents 0, 1, 2 or 3; $X_2^-$ above; and i has the same significance as s and t.

7. A negative silver halide photographic light-sensitive material as claimed in claim 1, wherein said hydrazine derivative, cationic dye, and compound of formula (I) are contained in amounts of from $10^{-6}$ to $10^{-1}$ mol, from $10^{-7}$ to $10^{-2}$ mol, and from $10^{-6}$ to $10^{-2}$ mol, respectively, per mol of silver halide.

8. A negative silver halide photographic light-sensitive material as claimed in claim 1, wherein said hydrazine, cationic dye, and compound of formula (I) are contained in the silver halide emulsion layer.

9. A negative silver halide photographic light-sensitive material as claimed in claim 1, wherein silver halide contained in said silver halide emulsion layer is composed of more than 70 mol% of silver bromide.

10. A negative silver halide photographic light-sensitive material as claimed in claim 9, wherein silver halide contained in said silver halide emulsion layer is composed of more than 90 mol% of silver bromide.

11. A negative silver halide photographic light-sensitive material as claimed in claim 1, wherein silver halide grains contained in said silver halide emulsion layer are grains having a mean grain size of less than 0.7 μm.

12. A negative silver halide photographic light-sensitive material as claimed in claim 11, wherein silver halide grains contained in said silver halide emulsion layer are grains having a mean grain size of less than 0.5 μm.

13. A negative silver halide photographic light-sensitive material as claimed in claim 1, which further contains from $10^{-3}$ to 0.5 g/m$^2$ of a development accelerator in said silver halide emulsion layer or said another hydrophilic colloid layer.

14. A negative silver halide photographic light-sensitive material as claimed in claim 1, which further contains from 0.05 to 3 g/m$^2$ of a compound having an acid group selected from the group consisting of salicyclic acid, acetic acid, ascorbic acid, and a polymer or copolymer containing acrylic acid, mateic acid or phthalic acid as a recurring unit.

* * * * *